US008295736B2

(12) United States Patent
Funamoto et al.

(10) Patent No.: US 8,295,736 B2
(45) Date of Patent: Oct. 23, 2012

(54) IMAGE FORMING APPARATUS

(75) Inventors: Noriaki Funamoto, Tokyo (JP); Yasuhisa Ehara, Kanagawa (JP); Tetsuji Nishikawa, Tokyo (JP); Yasuhiro Maehata, Kanagawa (JP); Jun Yasuda, Chiba (JP)

(73) Assignee: Ricoh Company, Limited, Tokyo (JP)

( * ) Notice: Subject to any disclaimer, the term of this patent is extended or adjusted under 35 U.S.C. 154(b) by 318 days.

(21) Appl. No.: 12/654,748

(22) Filed: Dec. 30, 2009

(65) Prior Publication Data

US 2010/0183322 A1 Jul. 22, 2010

(30) Foreign Application Priority Data

Jan. 19, 2009 (JP) ..... 2009-008355

(51) Int. Cl.
*G03G 15/00* (2006.01)

(52) U.S. Cl. ..... 399/167; 399/47

(58) Field of Classification Search ..... 399/49, 399/167

See application file for complete search history.

(56) References Cited

U.S. PATENT DOCUMENTS

2007/0092297 A1* 4/2007 Shimura et al. ..... 399/167
2008/0170884 A1* 7/2008 Matsuda ..... 399/167

FOREIGN PATENT DOCUMENTS

| | | |
|---|---|---|
| JP | 3347361 | 9/2002 |
| JP | 2004-219873 | 8/2004 |
| JP | 2004-220006 | 8/2004 |
| JP | 2005-195679 | 7/2005 |
| JP | 2006-235103 | 9/2006 |
| JP | 3965357 | 6/2007 |
| JP | 2008-139614 | 6/2008 |

OTHER PUBLICATIONS

Machine translation of Ebara (JP 2008139614 A, listed in IDS). Publication date, Jun. 19, 2008.*
Abstract of JP 2004-187413 published on Jul. 2, 2004.
Abstract of JP 05-341589 published on Dec. 24, 1993.

* cited by examiner

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

In an image forming apparatus, a rotation detector detects an angular velocity or an angular displacement of a shared drive motor, or an angular velocity or an angular displacement of a photosensitive element. A drive control unit executes a process for controlling a drive speed of a drive source of the photosensitive element based on a result of detection by the rotation detector.

8 Claims, 12 Drawing Sheets

IMAGE FORMING APPARATUS

CROSS-REFERENCE TO RELATED APPLICATIONS

The present application claims priority to and incorporates by reference the entire contents of Japanese Patent Application No. 2009-008355 filed in Japan on Jan. 19, 2009.

BACKGROUND OF THE INVENTION

1. Field of the Invention

The present invention relates to an image forming apparatus that transfers visible images form image carriers to a surface of an endless belt or to a recording member held on the surface of the endless bet.

2. Description of the Related Art

In a typical image forming apparatus, toner images of mutually different colors are first formed on respective image carriers and a color image is then created by transferring those toner images in a superimposed manner from the image carriers onto the surface of an endless belt. In some image forming apparatus the toner images are transferred onto a recording paper held on the surface of the belt instead of transferring them directly on the belt.

The belt is stretched over rollers so as to form a loop. One of the rollers functions as a drive roller and others function as driven rollers. A belt drive motor drives the drive roller so that the belt rotates at a constant speed. However, the diameter of the drive roller may change due to changes in the environmental temperature over time. If this happens, the belt does not rotate at the intended speed. This leads to occurrence of misregistration between the toner images of the colors (color misregistration).

Meanwhile, there has been conventionally known an image forming apparatus that endlessly moves a belt member at a predetermined target velocity by detecting a moving velocity of the belt member by a velocity detector and feeding back the result of detection to a drive speed of a belt drive motor (for example, see Japanese Patent Application Laid-open No. 2004-220006 and Japanese Patent No. 3965357). This configuration allows the endless movement of the belt member at the target speed even if the diameter of the drive roller is changed due to changes in the temperature.

The inventors of the present invention are doing research whereby it is possible to share the drive motor between one of a plurality of photosensitive elements and the belt member. This configuration leads to reduction in cost of the configuration in which the belt member is caused to endlessly move at a target speed in the above manner. More specifically, when there are four photosensitive elements corresponding to toner images of Y (yellow), C (cyan), M (magenta), and K (black), the drive motor is shared between the photosensitive element for K and the belt member. As an object for dual purpose, the photosensitive element for K is selected from among the four colors for some reasons as explained below. Namely, conventionally, in a print job in monochrome mode, it is general that wasteful energy consumption and occurrence of wear of components are reduced by driving only the photosensitive element for K and stopping the drive of the photosensitive elements for Y, C, and M. Even if the configuration is adopted, if the photosensitive element for K is selected as the photosensitive element that shares the drive motor with the belt member, the belt member can be driven irrespective of different modes.

However, if at least one of the photosensitive elements, which is not necessarily the photosensitive element for K, shares the drive motor with the belt member, a following problem arises. More specifically, for the purpose of endless movement of the belt member at the target velocity, if the drive speed of a shared drive motor is controlled based on the result of detecting the belt velocity, an angular velocity of the photosensitive element driven by the shared drive motor may differ from that of the other photosensitive elements depending on the diameter of the drive roller. Such a difference in linear velocity between the photosensitive elements causes misregistration between the toner image on the photosensitive element of the former and the toner images on the other photosensitive elements.

SUMMARY OF THE INVENTION

It is an object of the present invention to at least partially solve the problems in the conventional technology.

According to an aspect of the present invention, there is provided an image forming apparatus including a movable image carrier corresponding to each of a plurality of colors and configured to carry a visible image of a corresponding one of the colors on a surface thereof; a plurality of image-carrier drive sources configured to drive one or more of the image carriers; a belt member that is stretched and supported by a plurality of stretching and supporting members in the vicinity of the image carriers; a drive rotating body configured to support the belt member and when driven causes the belt member to endlessly move over the stretching and supporting members; a belt drive source configured to drive the drive rotating body, wherein one of the image-carrier drive sources functions as the belt drive source as a shared drive source; a velocity fluctuation detector configured to detect velocity fluctuation of the belt member when driven by the belt drive source; a drive control unit configured to control a drive speed of the belt drive source based on the velocity fluctuation detected by the velocity fluctuation detector; and a transfer unit configured to transfer the visible images from the surfaces of the image carriers onto a surface of the belt member or to a recording member held on the surface thereof. The drive control unit executes a process for controlling a drive speed of the image-carrier drive sources other than the shared drive source based on the drive speed of the shared drive source or based on the velocity of the image carrier driven by the shared drive source.

According to another aspect of the present invention, there is provided an image forming apparatus including a rotatable image carrier corresponding to each of a plurality of colors and configured to carry a visible image of a corresponding one of the colors on a surface thereof; a plurality of image-carrier drive sources configured to drive one or more of the image carriers; a belt member that is stretched and supported by a plurality of stretching and supporting members in the vicinity of the image carriers; a drive rotating body configured to support the belt member and when driven causes the belt member to endlessly move over the stretching and supporting members; a belt drive source configured to drive the drive rotating body, wherein one of the image-carrier drive sources functions as the belt drive source as a shared drive source; a velocity detector configured to detect velocity of the belt member when driven by the belt drive source; a drive control unit configured to control a drive speed of the belt drive source based on a result of detection by the velocity detector; a transfer unit configured to transfer the visible images from the surfaces of the image carriers onto a surface of the belt member or to a recording member held on the surface thereof; and a rotation detector configured to detect a parameter indicative of at least one among an angular velocity and an angular displacement of the shared drive source and an angular velocity and an angular displacement of the image carrier driven by the shared drive source. The drive control unit executes a process for controlling a drive speed of the image-carrier drive sources other than the shared drive source based on the parameter detected by the rotation detector.

According to still another aspect of the present invention, there is provided an image forming apparatus including a movable image carrier corresponding to each of a plurality of colors and configured to carry a visible image of a corresponding one of the colors on a surface thereof; a plurality of image-carrier drive sources configured to drive one or more of the image carriers; a belt member that is stretched and supported by a plurality of stretching and supporting members in the vicinity of the image carriers; a belt drive source configured to drive the belt member, wherein one of the image-carrier drive sources functions as the belt drive source as a shared drive source; a velocity detector configured to detect a velocity of the belt member when driven by the belt drive source; a drive control unit configured to control a drive speed of the belt drive source based on a result of detection by the velocity detector; and a transfer unit configured to transfer the visible images from the surfaces of the image carriers onto a surface of the belt member or to a recording member held on the surface thereof. The velocity detector detects the velocity of the belt member when driven by the shared drive source at least one detection timings selected from each time power of the image forming apparatus is turned on, each time a continuous stop time exceeds a predetermined first value, each time number of times of execution of an image forming operation exceeds a predetermined second value, and each time number of times of execution of an image forming operation in a continuous operation mode for continuously performing the image forming operation on a plurality of recording members exceeds a predetermined third value, and the drive control unit executes a process for determining a drive speed of the shared drive source and drive speeds of the image-carrier drive sources other than the shared drive source in subsequent image forming operations based on the velocity detection by the velocity detector.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image forming apparatus according to the present invention are explained below while referring to the accompanying drawings. The present invention is not limited to the embodiments explained below.

As an image forming apparatus to which the present invention is applied, a first embodiment of an electrophotographic printer (hereinafter, simply called "printer") is explained below.

Figure 1:
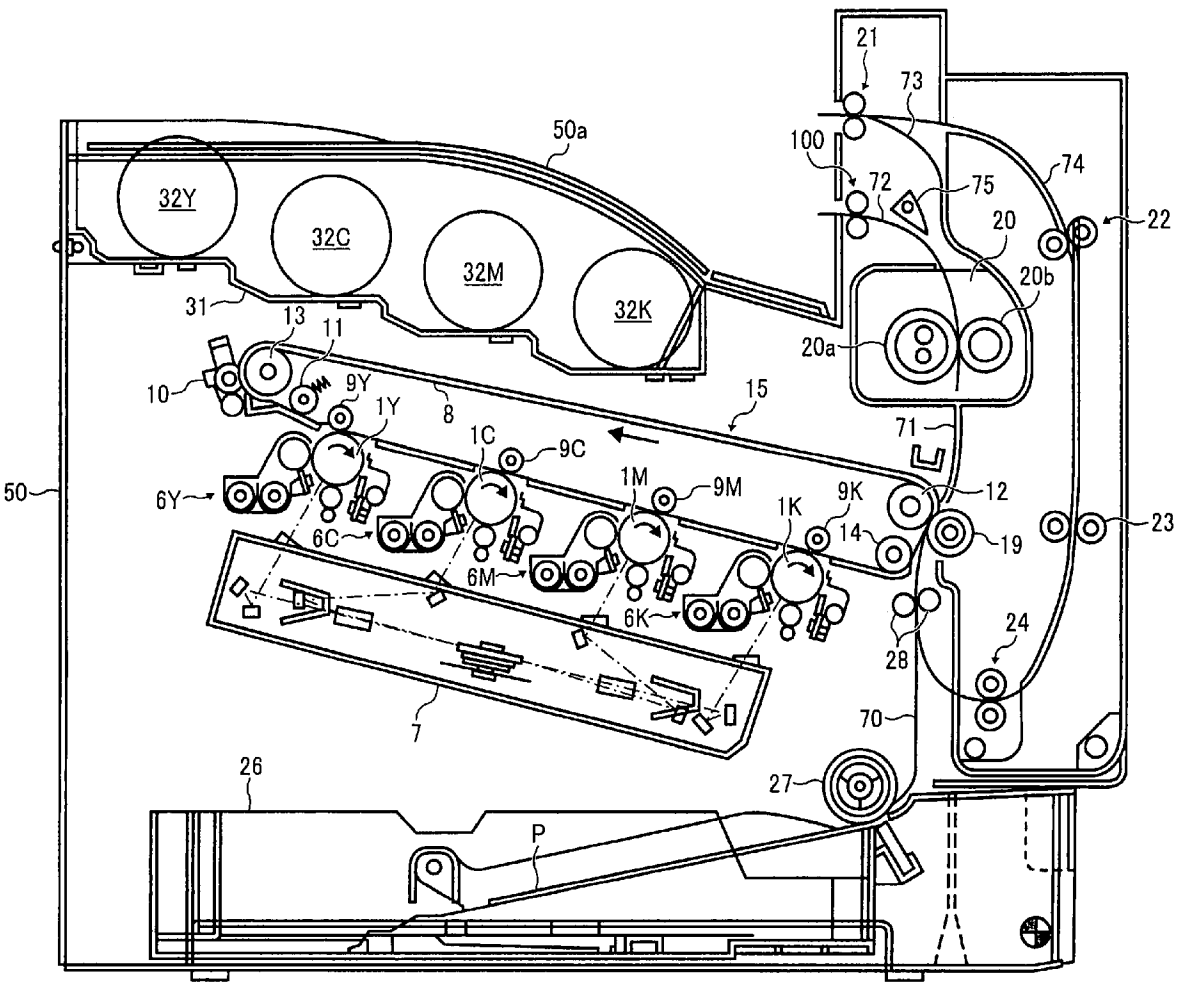
FIG. 1 is a schematic configuration diagram representing a printer according to a first embodiment of the present invention.
Figure 2:
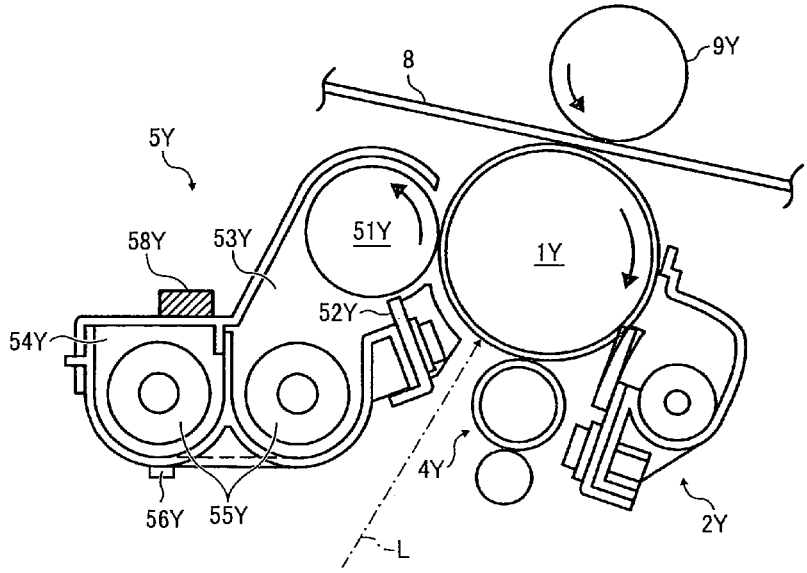
FIG. 2 is an enlarged view of a process unit for Y shown in FIG. 1.

First, a basic configuration of a printer 50 according to the first embodiment is explained below. FIG. 1 is a schematic configuration diagram representing the printer 50. In this figure, the printer 50 includes four process units 6Y, 6C, 6M, and 6K for forming toner images of yellow, cyan, magenta, and black (hereinafter, described as Y, C, M, and K, respectively). These process units use Y, C, M, K toners of mutually different colors as image forming substance, respectively, but have the same configuration as one another except for the toners and are replaced at the end of their life. Let's take a process unit 6Y for generating a Y-toner image as an example. As shown in FIG. 2, the process unit 6Y includes a drum-shaped photosensitive element 1Y being an image carrier, a drum cleaning unit 2Y, a decharging unit (not shown), a charging unit 4Y, and a developing unit 5Y. The process unit 6Y is detachably attached to the printer body, so that consumable parts can be replaced at a time.

The charging unit 4Y uniformly charges the surface of the photosensitive element 1Y caused to rotate clockwise in FIG. 2 by a drive unit (not shown). The uniformly charged surface of the photosensitive element 1Y is scanned with laser beam L for exposure to carry a Y-electrostatic latent image thereon. The Y-electrostatic latent image is developed into a Y toner image by the developing unit 5Y using Y developer that contains Y toner and magnetic carrier. The Y toner image is then intermediately transferred to an intermediate transfer belt 8 being a belt member explained later. The drum cleaning unit 2Y removes residual toner on the surface of the photosensitive element 1Y after the intermediate transfer process. The decharging unit decharges residual charge on the photosensitive element 1Y after being cleaned. The surface of the photosensitive element 1Y is initialized by the decharging to be ready for next image formation. In the process units for the other colors (6C, 6M, 6K), (C, M, K) toner images are formed on the photosensitive elements (1C, 1M, 1K) respectively in the above manner, and are intermediately transferred to the intermediate transfer belt 8.

The developing unit 5Y includes a developing roll 51Y provided so as to be partially exposed from an opening of a casing of the developing unit 5Y. The developing unit 5Y also includes two conveyor screws 55Y arranged in parallel to one another, a doctor blade 52Y, and a toner concentration sensor (hereinafter, called "T sensor") 56Y.

Stored in the casing of the developing unit 5Y is the Y developer (not shown) containing the magnetic carrier and the Y toner. The Y developer is charged by friction while being stirred and conveyed by the two conveyor screws 55Y, and, thereafter, is carried on the surface of the developing roll 51Y. A layer thickness of the Y developer is controlled by the doctor blade 52Y, and the Y developer is conveyed to a developing area opposed to the y-photosensitive element 1Y for Y, where the Y toner is made to adhere to the electrostatic latent image on the photosensitive element 1Y. With this adhesion, the Y toner image is formed on the photosensitive element 1Y. In the developing unit 5Y, the Y developer in which the Y toner is consumed due to development is returned into the casing with the rotation of the developing roll 51Y.

A partition wall is provided between the two conveyor screws 55Y. The partition wall divides the casing into a first supply unit 53Y that includes the developing roll 51Y and the conveyor screw 55Y on the right side in FIG. 2 and into a second supply unit 54Y that includes the conveyor screw 55Y on the left side in FIG. 2. The conveyor screw 55Y on the right side in FIG. 2 is driven to rotate by the drive unit (not shown), supplies the Y developer in the first supply unit 53Y to the developing roll 51Y while conveying the Y developer from the front side to the back side in FIG. 2. The Y developer conveyed up to near the end of the first supply unit 53Y by the conveyor screw 55Y on the right side in FIG. 2 passes through an opening (not shown) provided in the partition wall to enter the second supply unit 54Y. In the second supply unit 54Y, the conveyor screw 55Y on the left side in FIG. 2 is driven to rotate by the drive unit (not shown), and conveys the Y developer sent from the first supply unit 53Y in an opposite direction to the conveyor screw 55Y on the right side in FIG. 2. The Y developer conveyed up to near the end of the second supply unit 54Y by the conveyor screw 55Y on the left side in FIG. 2 passes through the other opening (not shown) provided in the partition wall to return to the first supply unit 53Y.

The T sensor 56Y formed with a permeability sensor is provided in a bottom wall of the second supply unit 54Y, and outputs a voltage of a value equivalent to a permeability of the Y developer having passed over the T sensor 56Y. The permeability of a two-component developer containing toner and magnetic carrier represents a good correlation with the toner concentration, and therefore the T sensor 56Y outputs a voltage of a value equivalent to the Y toner concentration. The value of the output voltage is sent to a controller (not shown). The controller is provided with a RAM that stores therein Vtref for Y being a target value of an output voltage output from the T sensor 56Y. Stored in the RAM are also data for Vtref for C, Vtref for M, and Vtref for K being target values of output voltages output from T sensors (not shown) mounted on the other developing units, respectively. The Vtref for Y is used for drive control of a Y-toner conveying device explained later. More specifically, the controller controls the drive of the Y-toner conveying device (not shown) to supply the Y toner into the second supply unit 54Y so that the value of the output voltage from the T sensor 56Y is brought close to the Vtref for Y. The supply allows the Y toner concentration in the Y developer inside the developing unit 5Y to be maintained within a predetermined range. In the developing units for the other process units, each toner supply control using C-, M-, and K-toner conveying devices is implemented in the above manner.

As previously shown in FIG. 1, an optical writing unit 7 being a latent-image writing unit is provided in the lower side of the process units 6Y, 6C, 6M, and 6K. The optical writing unit 7 irradiates and exposes the photosensitive elements in the process units 6Y, 6C, 6M, and 6K respectively with each laser light L emitted based on image information. With this exposure, electrostatic latent images for Y, C, M, and K are formed on the photosensitive elements 1Y, 1C, 1M, and 1K respectively. It should be noted that the optical writing unit 7 irradiates the laser light (L) emitted from a light source to each photosensitive element through a plurality of optical lenses and mirrors while scanning the laser light by a polygon mirror driven to rotate by a motor.

Placed in the lower side, in FIG. 1, of the optical writing unit 7 is a paper storage unit including a paper storage cassette or paper storage cassettes 26 in which a paper feeding roller 27 is incorporated. The paper storage cassettes 26 store therein a stack of transfer papers P which are sheet-type recording bodies, and the paper feeding roller 27 is in contact with each top transfer paper P of the paper storage cassettes 26. If the paper feeding roller 27 is caused to rotate counterclockwise in FIG. 1 by the drive unit (not shown), then the top transfer paper P is fed to a paper feeding path 70.

A registration roller pair 28 is provided near the end of the paper feeding path 70. The registration roller pair 28 is caused to rotate both rollers so as to hold the transfer paper P therebetween, however, the registration roller pair 28 is stopped once in response to the holding thereof. Then, the registration roller pair 28 feeds the transfer paper P to a secondary transfer nip explained later in appropriate timing.

Provided in the upper side, in FIG. 1, of the process units 6Y, 6C, 6M, and 6K is a transfer unit 15 caused to endlessly move while stretching and supporting the intermediate transfer belt 8. The transfer unit 15 being a transfer unit includes, in addition to the intermediate transfer belt 8, a secondary-transfer bias roller 19, and a belt cleaning device 10. The transfer unit 15 also includes four primary-transfer bias rollers 9Y, 9C, 9M, and 9K, a drive roller 12, a cleaning backup roller 13, a driven roller 14, and a tension roller 11. The intermediate transfer belt 8 is caused to endlessly move counterclockwise in FIG. 1 through rotational drive of the drive roller 12 while being stretched and supported by these rollers. The primary-transfer bias rollers 9Y, 9C, 9M, and 9K hold the intermediate transfer belt 8 caused to endlessly move in this manner with the photosensitive elements 1Y, 1C, 1M, and 1K to form primary transfer nips respectively. These components function based on a system of applying a transfer bias with opposite polarity (for example, positive) of that of the toner to the backside (inner circumferential surface of the loop) of the intermediate transfer belt 8. All the rollers except for the primary-transfer bias rollers 9Y, 9C, 9M, and 9K are electrically grounded. Primarily transferred to the intermediate transfer belt 8 are Y, C, M, and K toner images on the photosensitive elements 1Y, 1C, 1M, and 1K respectively in a superposition manner during the process of sequentially passing through the primary transfer nips for Y, C, M, and K in association with the endless movement of the intermediate transfer belt 8. Thus, the four superimposed toner images (hereinafter, called "four-color toner image") are formed on the intermediate transfer belt 8.

The drive roller 12 being a drive rotating body holds the intermediate transfer belt 8 with the secondary-transfer bias roller 19 to form the secondary transfer nip. The four-color toner image being a visible image formed on the intermediate transfer belt 8 is transferred to the transfer paper P at the secondary transfer nip. The transferred image is made a full-color toner image with a white color of the transfer paper P. Residual toner after transfer that has not been transferred to the transfer paper P adheres to the intermediate transfer belt 8 having passed through the secondary transfer nip. This is cleaned by the belt cleaning device 10. The transfer paper P to which the four-color toner image is collectively and secondarily transferred at the secondary transfer nip is sent to a fixing unit 20 through a post-transfer conveyance path 71.

The fixing unit 20 forms a fixing nip by a fixing roller 20*a* with a heat source such as a halogen lamp provided inside thereof and by a pressing roller 20*b* that rotates while being in contact with the fixing roller 20*a* with a predetermined pressure. The transfer paper P fed into the fixing unit 20 is held into the fixing nip so that a toner-image-carried surface of the transfer paper P not yet being fixed is brought into close contact with the fixing roller 20*a*. The toner in the toner image is softened under the effect of heating and pressure, and a full-color image is thereby fixed thereon.

The transfer paper P on which the full-color image is fixed in the fixing unit 20 exits the fixing unit 20, and then approaches a separation point between a paper ejection path 72 and a pre-reverse conveyance path 73. A first switching claw 75 is swingably provided at the separation point, and the course of the transfer paper P is switched by swinging of the first switching claw 75. More specifically, the tip of the claw is moved to a direction of approaching the pre-reverse conveyance path 73, to thereby change the course of the transfer paper P to a direction toward the paper ejection path 72. Furthermore, the tip of the claw is moved to a direction of being away from the pre-reverse conveyance path 73, to thereby change the course of the transfer paper P to the direction toward the pre-reverse conveyance path 73.

If the course toward the paper ejection path 72 is selected by the first switching claw 75, the transfer paper P passes from the paper ejection path 72 through a paper-ejection roller pair 100 and is ejected outside the machine, to be stacked on a stack portion 50*a* provided on the top face of the printer housing. On the other hand, if the course toward the pre-reverse conveyance path 73 is selected by the first switching claw 75, the transfer paper P passes through the pre-reverse conveyance path 73 and enters a nip of a reverse roller pair 21. The reverse roller pair 21 conveys the transfer paper P held between the rollers to the stack portion 50*a*, but reversely rotates the rollers right before the trailing edge of the transfer paper P is caused to enter the nip. The reverse rotation causes the transfer paper P to be conveyed in a direction opposite to the direction, and the trailing edge side of the transfer paper P enters a reverse conveyance path 74.

The reverse conveyance path 74 is formed into an elongating shape while being bent from the upper side toward the lower side in a vertical direction. Provided inside the path are a first reverse conveying roller pair 22, a second reverse conveying roller pair 23, and a third reverse conveying roller pair 24. The transfer paper P is conveyed while sequentially passing through nips of these roller pairs, to be thereby turned upside down. The transfer paper P after having been turned upside down is returned to the paper feeding path 70, and then reaches again the secondary transfer nip. This time a non-image carrying surface thereof is caused to enter the secondary transfer nip while being close contact with the intermediate transfer belt 8, where a second four-color toner image on the intermediate transfer belt is collectively and secondarily transferred to the non-image carrying surface thereof. Thereafter, the transfer paper P passes through the post-transfer conveyance path 71, the fixing unit 20, the paper ejection path 72, and the paper-ejection roller pair 100, to be stacked on the stack portion 50*a* provided outside the machine. Through the reverse conveyance, full-color images are formed on both sides of the transfer paper P.

A bottle support unit 31 is provided between the transfer unit 15 and the stack portion 50*a* provided in the upper side from the transfer unit 15. The bottle support unit 31 incorporates toner bottles 32Y, 32C, 32M, and 32K being toner containers for containing therein Y, C, M, and K toners respectively. The toner bottles 32Y, 32C, 32M, and 32K are arranged so as to be mutually placed at an angle slightly inclined than a horizontal line, and arranged positions are made higher in order of Y, C, M, and K. The Y, C, M, and K toners in the toner bottles 32Y, 32C, 32M, and 32K are supplied as necessary to the developing units in the process units 6Y, 6C, 6M, and 6K by toner conveying units explained later, respectively. The toner bottles 32Y, 32C, 32M, and 32K are detachably attached to the printer body, independently from the process units 6Y, 6C, 6M, and 6K respectively.

The present printer has a monochrome mode in which a mono-color image is formed and a color mode in which a color image is formed, which cause a contact state between the photosensitive element and the intermediate transfer belt to be different from each other. More specifically, among the four primary-transfer bias rollers 9Y, 9C, 9M, and 9K in the transfer unit 15, the primary-transfer bias roller 9K for K is supported by a dedicated bracket (not shown) separately from the other primary-transfer bias rollers. The three primary-transfer bias rollers 9Y, 9C, and 9M for Y, C, and M are supported by a common mobile bracket (not shown). The mobile bracket can be moved in a direction of being closer to the photosensitive elements 1Y, 1C, and 1M for Y, C, and M, and in a direction of being away from the photosensitive elements 1Y, 1C, and 1M by driving a solenoid (not shown). When the mobile bracket is moved in the direction being away from the photosensitive elements 1Y, 1C, and 1M, the stretched state of the intermediate transfer belt 8 is changed, so that the intermediate transfer belt 8 separates from the three photosensitive elements 1Y, 1C, and 1M for Y, C, and M. However, the photosensitive element 1K for K and the intermediate transfer belt 8 are kept in contact with each other. In the monochrome mode, an image forming operation is performed in the above manner in the state in which only the photosensitive element 1K for K is kept in contact with the intermediate transfer belt 8. At this time, of the four photosensitive elements, only the photosensitive element 1K for K is driven to rotate, while the photosensitive elements 1Y, 10, and 1M for Y, C, and M are stopped driving.

When the mobile bracket is moved in the direction of being closer to the three photosensitive elements 1Y, 1C, and 1M, the stretched state of the intermediate transfer belt 8 changes, and the intermediate transfer belt 8 separated so far from the three photosensitive elements 1Y, 10, and 1M comes in contact with the three photosensitive elements 1Y, 1C, and 1M. At this time, the photosensitive element 1K for K and the intermediate transfer belt 8 are kept in contact with each other. In the color mode, an image forming operation is performed in this manner in the state in which all the four photosensitive elements 1Y, 10, 1M, and 1K are in contact with the intermediate transfer belt 8. In this configuration, the mobile bracket and the solenoid or the like function as a contact/separation unit that causes the photosensitive element and the intermediate transfer belt 8 to contact each other or to separate each other.

The present printer includes a main controller (not shown) being a control unit that controls the drive of the four process units 6Y, 6C, 6M, and 6K and the optical writing unit 7. The main controller includes a CPU (central processing unit) being a computing unit, a RAM (random access memory) being a data storage unit, and a ROM (read only memory) being a data storage unit, and controls the drive of the process units and the optical writing unit based on programs stored in the ROM.

Moreover, the present printer includes a drive controller (not shown) separately from the main controller. The drive controller includes a CPU, a ROM, and a nonvolatile RAM being a data storage unit, and controls the drive of a shared drive motor and a photosensitive-element motor, explained later, based on programs stored in the ROM.

Figure 3:
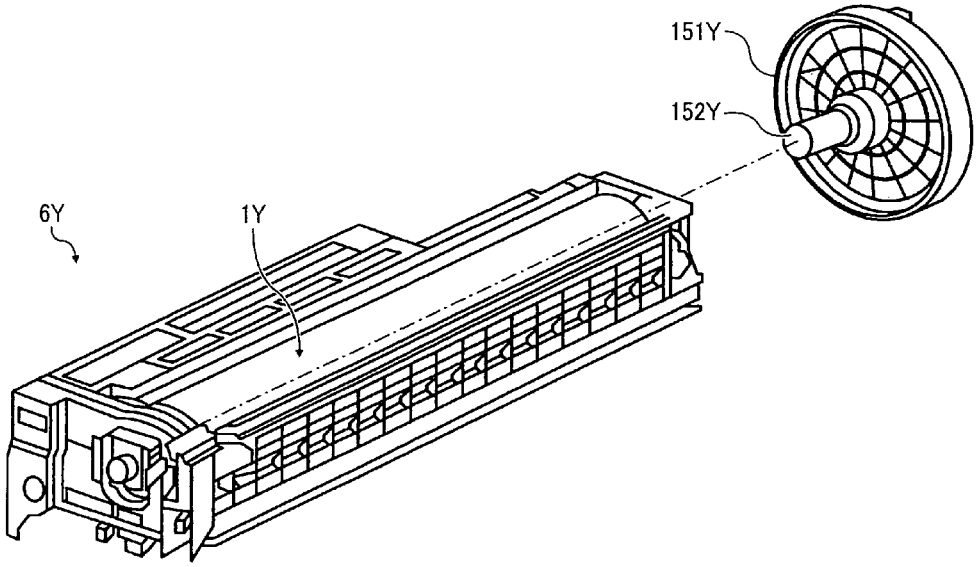
FIG. 3 is a perspective view illustrating the process unit for Y and a corresponding photosensitive-element gear.

FIG. 3 is a perspective view illustrating the process unit 6Y for Y detachably attached to the printer body, and a photosensitive-element gear 151Y for Y fixed to the printer body. The photosensitive-element gear 151Y is rotatably supported inside the printer body. Meanwhile, the process unit 6Y is detachably attached to the printer body. The photosensitive element 1Y of the process unit 6Y includes a cylindrical drum portion and shaft members protruding from both end faces of the drum portion in its rotation axis direction, and these shaft members are protruded to the outside of a housing of the unit. Of the two shaft members, a known coupling is fixed to the shaft member (not shown) on the backside in FIG. 3. A coupling portion 152Y is formed in the rotational center of the photosensitive-element gear 151Y on the printer body side. The coupling portion 152Y is coupled to the coupling fixed to the shaft member of the photosensitive element 1Y in the axial direction. With this coupling, rotational drive force of the photosensitive-element gear 151Y is transmitted to the photosensitive element 1Y through a coupling connection. When the process unit 6Y is pulled out of the printer body, the coupling (not shown) fixed to the shaft member of the photosensitive element 1Y and the coupling portion 152Y formed on the photosensitive-element gear 151Y are decoupled from each other. As for the process unit 6Y for Y, mechanisms of the coupling and the decoupling between the photosensitive element 1Y and the photosensitive-element gear 151Y when being attached and detached to and from the printer body have been explained, however, the process units for the other colors are also configured in the same manner as above.

Figure 4:
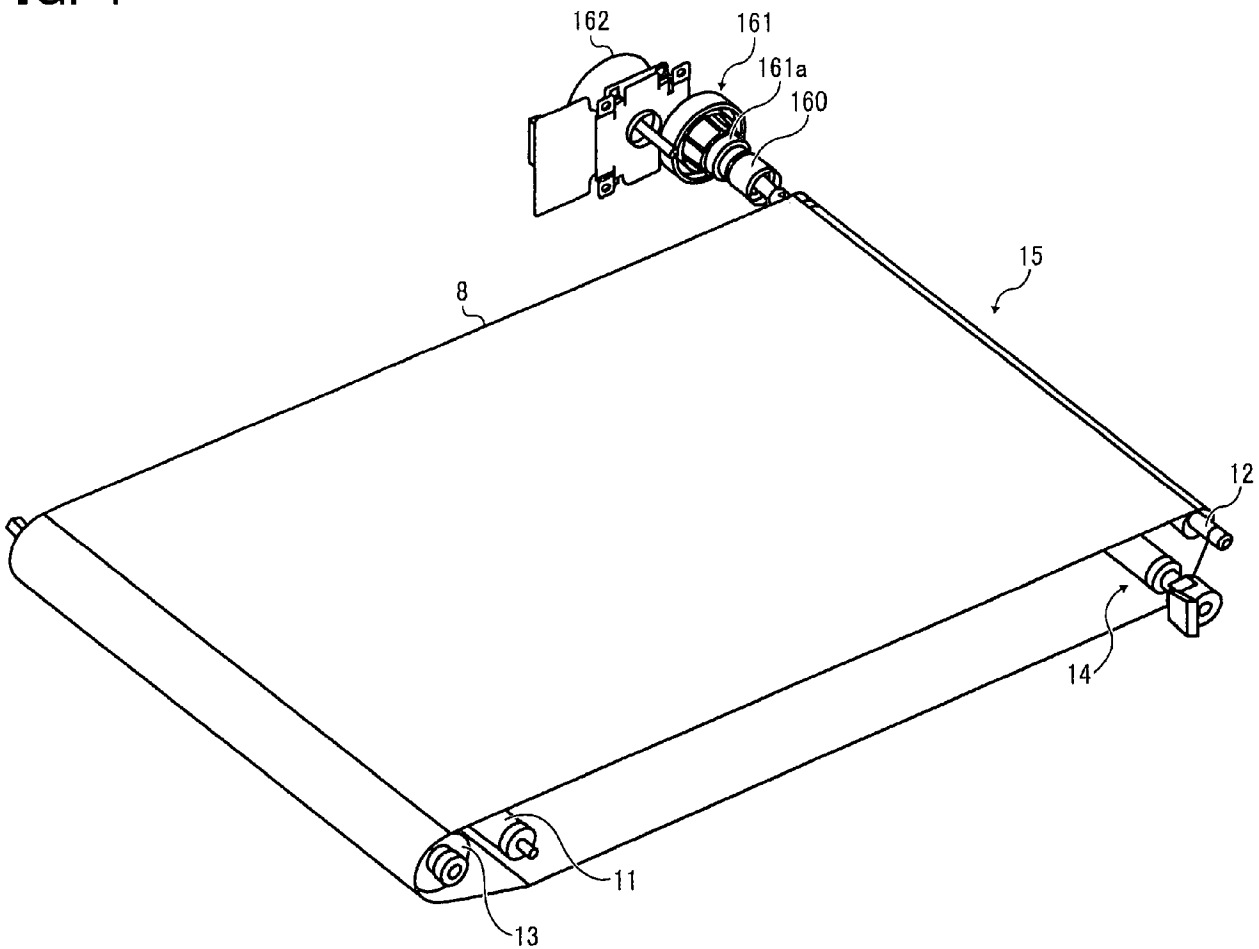
FIG. 4 is a perspective view illustrating a transfer unit and a motor for driving an intermediate transfer belt in the printer.
Figure 5:
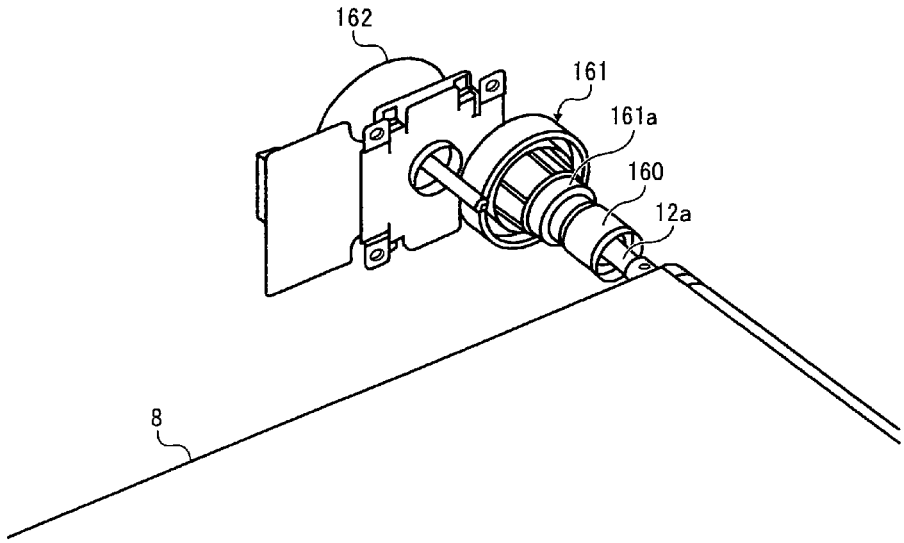
FIG. 5 is an enlarged perspective view of the motor and its peripheral structure.

FIG. 4 is a perspective view illustrating the transfer unit 15 and a motor that drives the intermediate transfer belt. FIG. 5 is an enlarged view of the motor and its peripheral structure. A coupling 160 is fixed to the end of a shaft portion 12*a* of the drive roller 12, in the axial direction, of which own rotational drive causes the intermediate transfer belt 8 to be endlessly moved in a state in which the intermediate transfer belt 8 is wound around the drive roller 12. Meanwhile, a belt-drive relay gear 161 is rotatably supported in the printer body, and a coupling portion 161*a* is formed in the central portion of the belt-drive relay gear 161. The transfer unit 15 is detachably attached to the printer body. FIG. 4 and FIG. 5 represent a state in which the transfer unit 15 is attached to the printer body. In this state, the coupling 160 fixed to the drive roller 12 of the transfer unit 15 and the coupling portion 161*a* of the belt-drive relay gear 161 supported in the printer body are coupled to each other in the axial direction. When the transfer unit 15 is pulled out of the printer body, the coupling 160 fixed to the drive roller 12 of the transfer unit 15 and the coupling portion 161*a* of the belt-drive relay gear 161 supported in the printer body are decoupled from each other.

A shared drive motor 162 is fixed near the belt-drive relay gear 161 in the printer body, and a motor gear of the shared drive motor 162 is engaged with the belt-drive relay gear 161. A mechanism thereof is such that when the shared drive motor 162 is driven to rotate, the drive force is transmitted to the intermediate transfer belt 8 through the belt-drive relay gear 161, the coupling connection, and the drive roller 12.

Figure 6:
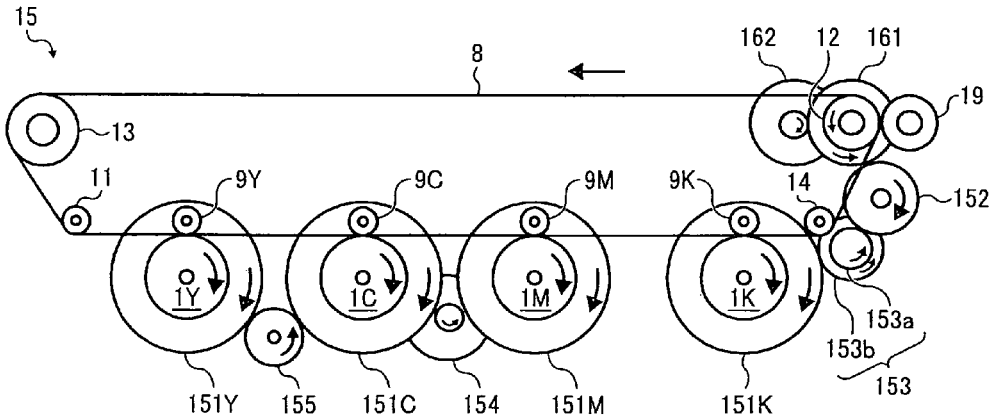
FIG. 6 is a schematic diagram representing a transfer unit, photosensitive elements for respective colors, and respective gears supported in the printer body in the printer.

FIG. 6 is a schematic diagram representing the transfer unit 15, the photosensitive elements 1Y, 1C, 1M, and 1K for the colors, and the gears supported in the printer body. In this figure, a first relay gear 152 for K, a second relay gear 153 for K, and a relay gear 155 for Y are rotatably supported in the printer body, in addition to the photosensitive-element gear 151Y and photosensitive-element gears 151C, 151M, and 151K for the colors and the belt-drive relay gear 161. Moreover, a color photosensitive-element motor 154 being an image-carrier drive source is fixed therein.

Engaged with the belt-drive relay gear 161 is the first relay gear 152 for K in addition to the motor gear of the shared drive motor 162. Arranged near the first relay gear 152 for K is the second relay gear 153 for K in which an input gear portion 153*a* and an output gear portion 153*b* are integrally formed on the same axis. The first relay gear 152 for K is also engaged with the input gear portion 153*a* of the second relay gear 153 for K. The output gear portion 153*b* of the second relay gear 153 for K is engaged with the photosensitive-element gear 151K for K. Based on the gear arrangement as above, the rotational drive force of the shared drive motor 162 is transmitted to the photosensitive element 1K for K through the belt-drive relay gear 161, the first relay gear 152 for K, the second relay gear 153 for K, and the photosensitive-element gear 151K for K. More specifically, in the present printer, the shared drive motor 162 functions as a belt drive source being a drive source of the drive roller 12 and of the intermediate transfer belt 8, and also functions as a drive source of the photosensitive element for K being one of image-carrier drive sources.

Meanwhile, the photosensitive elements 1Y, 1C, and 1M for Y, C, and M are driven by a drive source different from the shared drive motor 162. More specifically, the motor gear of the color photosensitive-element motor 154 being the image-carrier drive source fixed in the printer body is located between the photosensitive-element gear 151C for C and the photosensitive-element gear 151M for M. The motor gear is simultaneously engaged with these gears. This configures the motor gear of the color photosensitive-element motor 154 to directly transmit the rotational drive force to the photosensitive-element gear 151C for C and also directly transmit it to the photosensitive-element gear 151M for M.

The relay gear 155 for Y rotatably supported in the printer body is located between the photosensitive-element gear 151Y for Y and the photosensitive-element gear 151C for C, and is engaged with these photosensitive-element gears. The rotational drive force of the photosensitive-element gear 151C for C is transmitted to the photosensitive-element gear 151Y for Y through itself.

Figure 7:
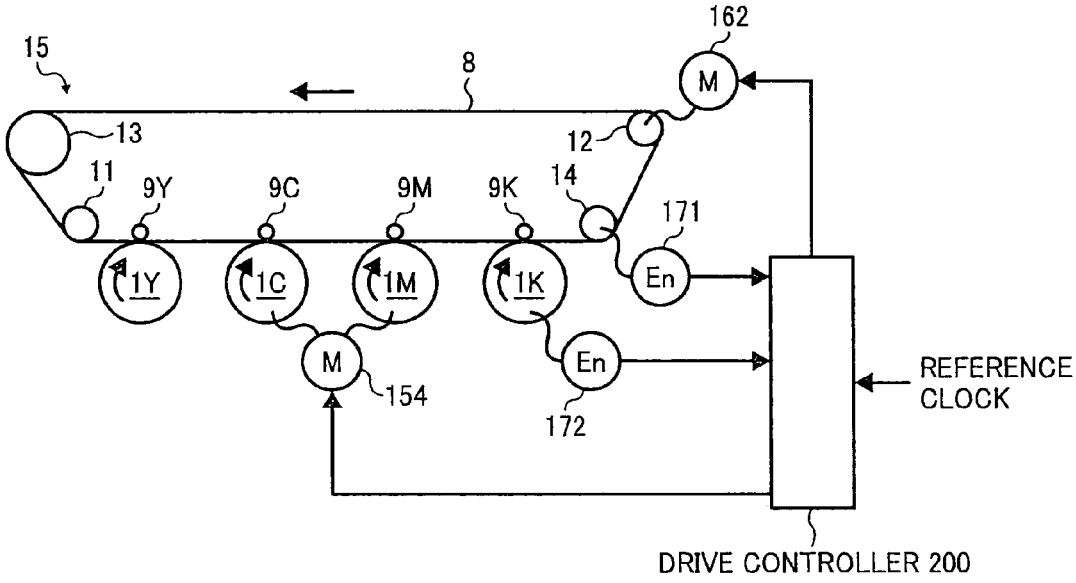
FIG. 7 is a schematic diagram representing a drive controller being a drive control unit and various devices electrically connected thereto.

FIG. 7 is a schematic diagram representing a drive controller 200 being a drive control unit and various devices electrically connected thereto. A linear velocity of the driven roller 14, which is one of stretching and supporting members that stretch and support the belt inside the loop of the intermediate transfer belt 8 and is driven to rotate following the endless movement of the belt, becomes the same as the linear velocity of the intermediate transfer belt 8. Consequently, an angular velocity and an angular displacement of the driven roller 14 indirectly indicate a velocity of endless movement of the intermediate transfer belt 8. Fixed to a shaft member of the driven roller 14 is a roller encoder 171 formed with a rotary encoder. The roller encoder 171 detects the angular velocity and the angular displacement of the driven roller 14 and outputs the result of detection to the drive controller 200. Such a roller encoder 171 functions as a velocity fluctuation detector that detects velocity fluctuation of the intermediate transfer belt 8 caused by a change in the diameter of the drive roller 12 in association with a change in temperature thereof. The roller encoder 171 also functions as a velocity detector that detects a velocity of endless movement of the intermediate transfer belt 8. The drive controller 200 can obtain the velocity fluctuation and the velocity of endless movement of the intermediate transfer belt 8 based on the output from the roller encoder 171.

It should be noted that the printer uses the roller encoder 171 that detects the angular velocity and the angular displacement of the driven roller 14, as the velocity fluctuation detector and the velocity detector, however, any other unit that detects the velocity fluctuation and the velocity using other method may be used. For example, there may be used an optical sensor in which a scale with a plurality of tick marks arranged at predetermined pitches in a belt circumferential direction is provided on the intermediate transfer belt and the velocity fluctuation of the belt and the velocity of the belt are detected based on an time interval for detecting the tick marks described in for example Japanese Patent Application Laid-open No. 2004-220006). An optical image sensor used for an optical mouse or the like being an input device of a personal computer may also be used as a unit for detecting the velocity fluctuation and the velocity of the surface of the belt. Moreover, a unit for estimating a belt velocity based on the result of detecting an in-unit temperature by a temperature sensor and based on a theoretical value of thermal expansion of the drive roller 12 may be provided as a detector.

During a continuous printing operation for continuously recording an image on a plurality of recording papers, the diameter of the drive roller 12 gradually increases with an increase in the temperature inside the printer along with the operation time. The diameter of the drive roller 12 gradually decreases with a decrease in the temperature inside the printer after the continuous printing operation is stopped. A relationship "$V=r\omega$" holds among a linear velocity V of the intermediate transfer belt 8, a radius r of the drive roller 12, and an angular velocity $\omega$ of the drive roller 12. Thus, if the angular velocity $\omega$ is set to be constant or if the drive speed of the shared drive motor 162 is made constant, the linear velocity V of the belt changes with a change in the diameter of the drive roller 12. This causes misregistration between the toner images of the colors to occur.

Therefore, the drive controller 200 performs phase locked loop (PLL) control for performing acceleration/deceleration control on the shared drive motor 162 so as to match the frequency of a pulse signal output from the roller encoder 171 with the frequency of a reference clock. This causes the driven roller 14 attached with the roller encoder 171 to be rotated at a constant angular velocity, to stabilize the velocity of the intermediate transfer belt 8 to a predetermined velocity. More specifically, by controlling the drive speed of the shared drive motor 162 based on the velocity fluctuation of and the velocity of the intermediate transfer belt 8, the intermediate transfer belt 8 is caused to endlessly move at a predetermined velocity irrespective of the change in the diameter of the drive roller 12.

In the PLL control, the velocity fluctuation in a short period of time within one cycle of the belt is detected, in addition to the velocity fluctuation in a long period caused by the change in the diameter of the drive roller 12 over time. The velocity fluctuation in the short period of time within the one cycle of the belt includes a sudden velocity fluctuation occurring when the recording paper enters the secondary transfer nip and a periodic velocity fluctuation caused by eccentricity of the drive roller 12. If the drive roller 12 is eccentric, a subtle velocity fluctuation like a one-cycle sine curve drawn per one cycle of the drive roller 12 appears in the intermediate transfer belt 8. In the PLL control, such a subtle velocity fluctuation is also detected and the result is reflected to the drive control of the shared drive motor 162, which also enables the velocity fluctuation even in the short period of time to be suppressed. In a case of suppressing only the velocity fluctuation in the long period of time caused by the change in the diameter of the drive roller 12 over time, a control method for detecting long-period velocity fluctuations may be adopted instead of the PLL control.

Figure 8:
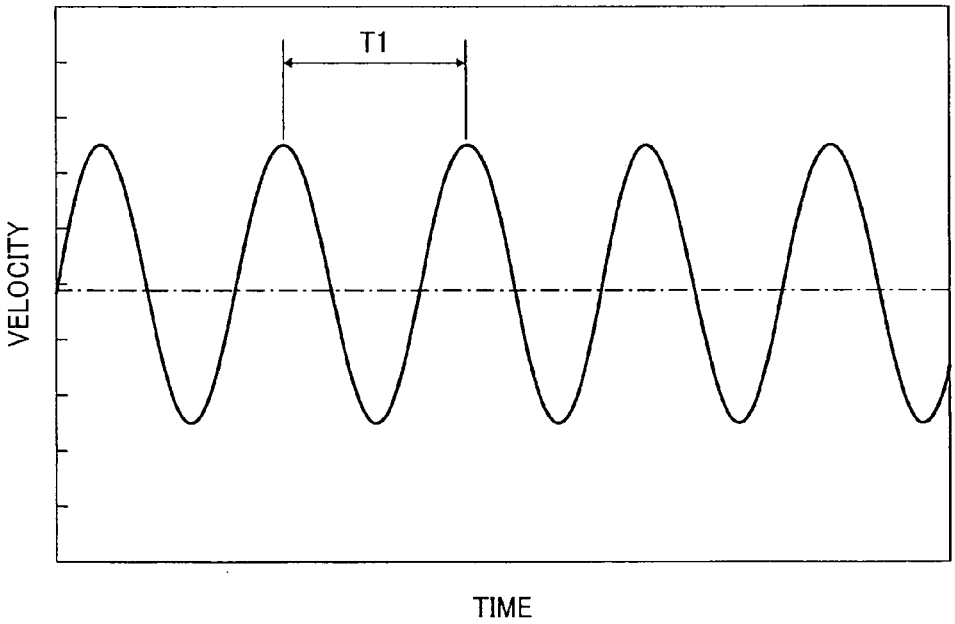
FIG. 8 is a graph representing a velocity fluctuation curve in synchronization with a rotation cycle of a drive roller appearing on a photosensitive element for K.
Figure 9:
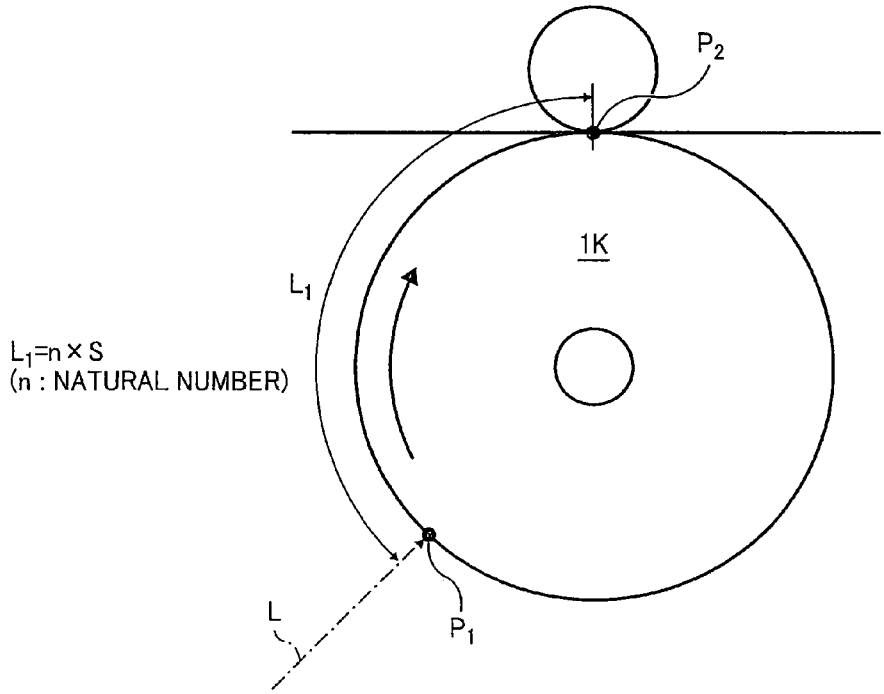
FIG. 9 is a schematic diagram for explaining a distance from an optical writing position on the surface of the photosensitive element for K to a center position of a transfer nip.

If the subtle velocity fluctuation caused by eccentricity of the drive roller 12 is detected and the result thereof is feedback-controlled to the drive control of the shared drive motor 162, this causes the linear velocity of the photosensitive element 1K for K to subtly fluctuate as shown in FIG. 8 instead of stabilizing the velocity of the intermediate transfer belt 8. The cycle of a sine-curved velocity fluctuation curve in this figure is the same as a rotation cycle of the drive roller 12. Even if the velocity fluctuation with such a cycle is caused to appear in the photosensitive element 1K for K, the following allows suppression of occurrence of image degradation caused by the velocity fluctuation. More specifically, as shown in FIG. 9, a writing to transfer distance $L_1$ being a distance from an optical writing position $P_1$ on the surface of the photosensitive element 1K for K to a center position $P_2$ at the primary transfer nip in a belt movement direction is set to an integral multiple of a circumferential length S of the drive roller 12. By setting so, the linear velocity of the photosensitive element 1K upon optical writing is made the same as that upon transfer, so that dot shapes of toner images to be transferred to the belt can be stabilized.

Figure 10:
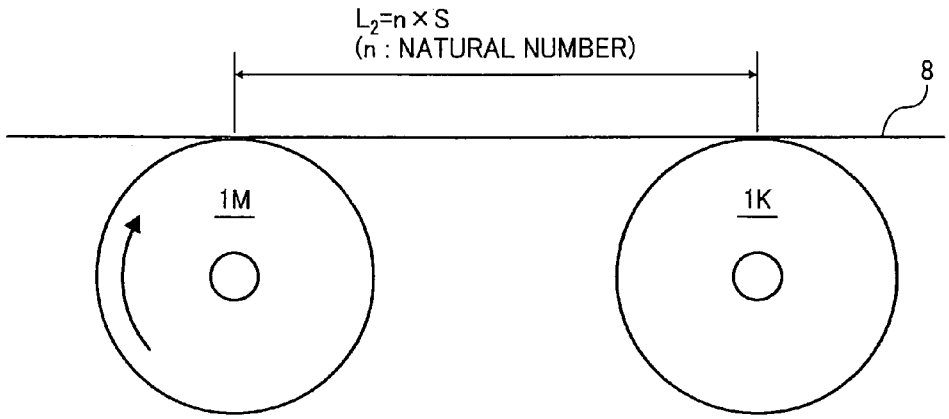
FIG. 10 is a schematic diagram for explaining a distance between the photosensitive elements.

If the setting as shown in FIG. 9 is difficult, as shown in FIG. 10, a distance $L_2$ between adjacent photosensitive elements being a pitch between the photosensitive elements is simply set to an integral multiple of the circumferential length S of the drive roller 12. The setting performed in this manner allows the linear velocities of the intermediate transfer belt 8 to match each other when the positions of the toner images in a sub-scanning direction pass through transfer nips respectively, so that the misregistration between the colors can be suppressed.

Incidentally, if the drive speed of the shared drive motor 162 is controlled so as to set the linear velocity of the intermediate transfer belt 8 to be constant regardless of a change in the diameter of the drive roller 12, the linear velocity of the photosensitive element 1K for K is caused to be subtly changed with the change in the diameter of the drive roller 12. Then, this causes occurrence of a linear velocity difference between the photosensitive elements 1Y, 1C, and 1M for Y, C, and M driven by the color photosensitive-element motor 154 and the photosensitive element 1K for K driven by the shared drive motor 162, which leads to occurrence of misregistration between the Y, C, and M toner images, and the K toner image.

Therefore, as previously shown in FIG. 7, the present printer includes a drum encoder 172, on a rotating shaft of the photosensitive element 1K for K, formed with a rotary encoder that detects an angular velocity or an angular displacement of the rotating shaft. Stored in a data storage unit (not shown) of the drive controller 200 is an algorithm or a data table to determine a control target of a drive speed of the color photosensitive-element motor 154 that enables the linear velocity of the photosensitive elements 1Y, 1C, and 1M for Y, C, and M to be matched with the linear velocity of the photosensitive element 1K for K based on an output (rotational velocity of the photosensitive element for K) from the drum encoder 172. The drive controller 200 is configured so as to implement a process for determining the control target based on the output from the drum encoder 172.

Figure 11:
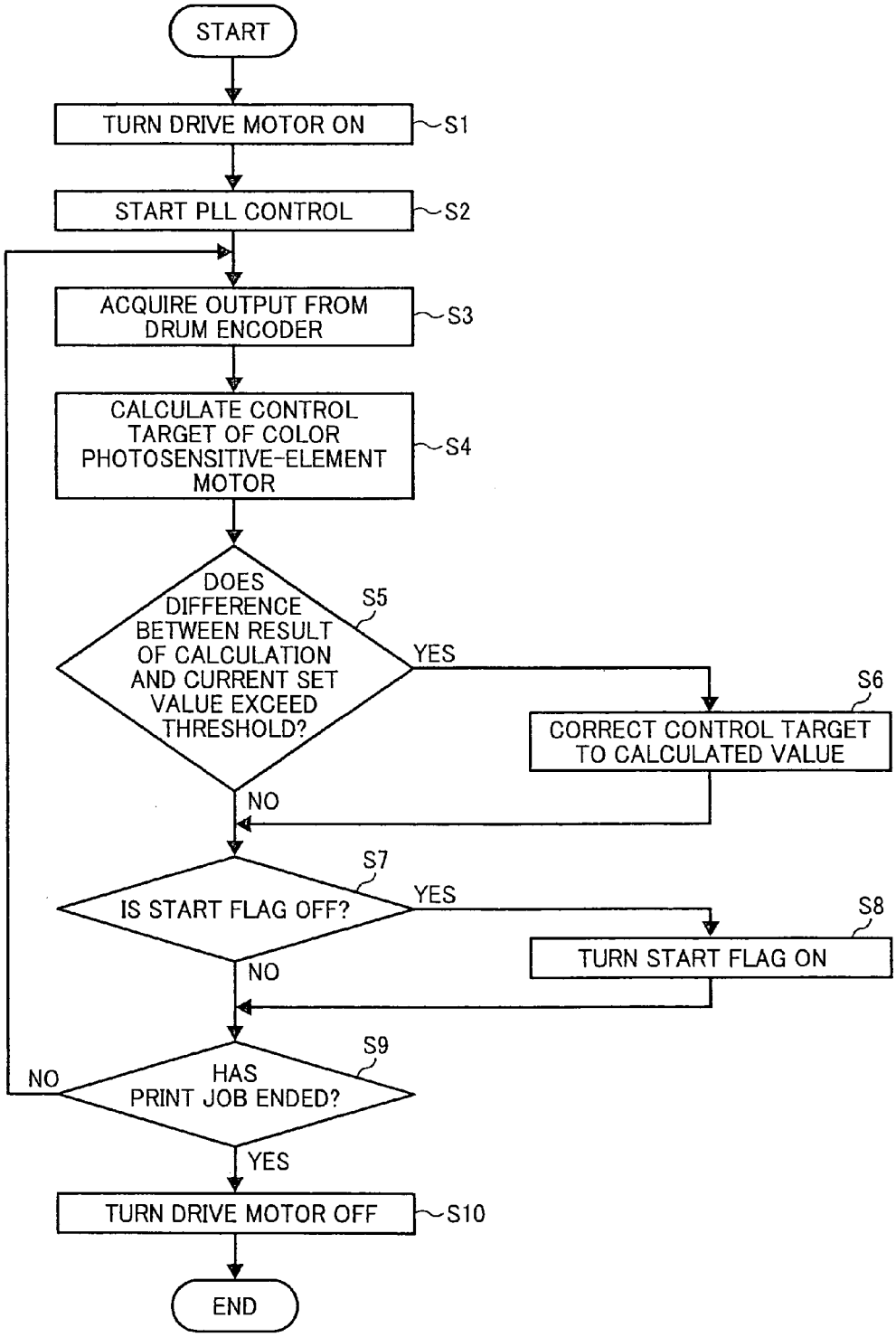
FIG. 11 is a flowchart representing a control flow executed by the drive controller in the printer.

FIG. 11 is a flowchart representing a control flow executed by the drive controller 200. When a print job starts, first, the drive of the shared drive motor 162 and the color photosensitive-element motor 154 is started (Step 1). For the shared drive motor 162, the PLL control is executed at once (Step S2), and the intermediate transfer belt 8 is thereby driven at a target linear velocity. The drive speed of the shared drive motor 162 at this time becomes a value according to the diameter of the drive roller 12. In addition, the linear velocity of the photosensitive element 1K for K becomes also a value according to the diameter of the drive roller 12. In order to match the linear velocity of the photosensitive elements 1Y, 1C, and 1M for Y, C, and M with the linear velocity of the photosensitive element 1K at this time, the drive controller 200 acquires an output value from the drum encoder (Step S3). The drive controller 200 calculates a control target of the drive speed of the color photosensitive-element motor 154 that can match the linear velocities with each other based on the output value and also based on the algorithm or the data table stored in the data storage unit (Step S4). If a difference between the result of calculation and a set value of current control target exceeds a predetermined threshold (Yes at Step S5), then, because it is worried about occurrence of the misregistration due to the linear velocity difference, the control target is corrected to a calculated value (Step S6). On the other hand, if the difference is equal to or less than the threshold (No at Step S5), the misregistration due to the linear velocity difference becomes a level without any problem, and thus the current control target is maintained. Thereafter, when a start flag is OFF, then the start flag is turned ON (Steps S7 and S8). The start flag is used to determine whether the flow for image processing is started, which is performed parallel to the shown flow. The flow for image processing is a flow for performing an optical writing process or a developing process. The start flag is turned OFF immediately after the print job starts.

In this state, it is configured that the flow for image processing is not started. The start flag is turned ON at Step S8, and the flow for the image processing is started. Thereafter, the flow at Steps S3 to S5 is repeatedly executed until the print job ends (Step S9) and the drive motor is tuned OFF (Step S10).

In the present printer configured in the above manner, by performing PLL-control on the shared drive motor 162 based on the result of detecting the velocity fluctuation and the velocity of the intermediate transfer belt 8, the intermediate transfer belt 8 can be endlessly moved at a target velocity regardless of any change in the diameter of the drive roller 12. In addition, by controlling the drive speed of the color photosensitive-element motor 154 based on an output, from the drum encoder 172 being a rotation detector, which reflects the velocity of the photosensitive element 1K for K driven by the shared drive motor 162, the linear velocity difference between the photosensitive element 1K for K and the photosensitive elements 1Y, 1C, and 1M for Y, C, and M is reduced. This also enables occurrence of the misregistration caused by the linear velocity difference to be suppressed.

Figure 12:
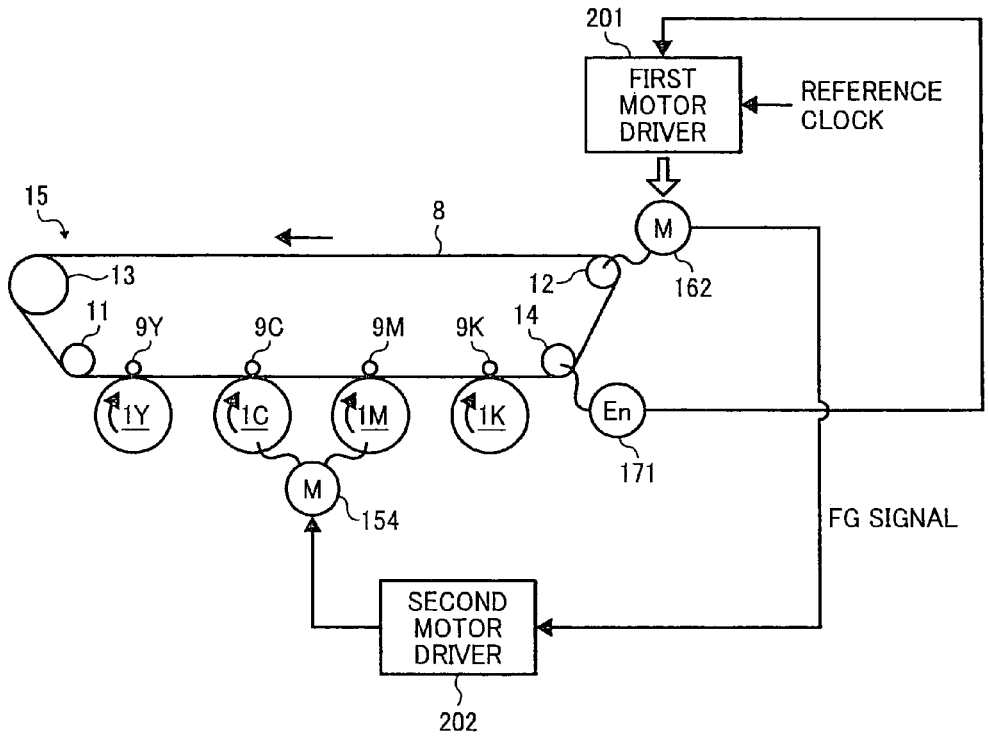
FIG. 12 is a schematic diagram representing a first motor driver, a second motor driver, and various devices connected thereto in a first modification of the printer according to the first embodiment.

FIG. 12 is a schematic diagram representing a first motor driver 201, a second motor driver 202, and various devices connected thereto in a first modification of the printer according to the first embodiment. In the printer according to the first modification, a combination of the first motor driver 201 and the second motor driver 202 functions as a drive control unit. Similarly to the drive controller 200 of the printer according to the first embodiment, the first motor driver 201 performs PLL-control on the shared drive motor 162 based on an output value from the roller encoder 171. This control causes the intermediate transfer belt 8 to endlessly move at the target velocity regardless of any change in the diameter of the drive roller 12.

Meanwhile, the second motor driver 202 controls the drive speed of the color photosensitive-element motor 154 based on an FG signal output from the shared drive motor 162. The shared drive motor 162 outputs the ES signal according to the angular velocity. The angular velocity of the shared drive motor 162 being the drive source of the photosensitive element 1K for K has a correlation with the linear velocity of the photosensitive element 1K. The second motor driver 202 stores therein an algorithm or a data table to determine a control target of the drive speed of the color photosensitive-element motor 154 that enables the linear velocity of the photosensitive elements 1Y, 1C, and 1M for Y, C, and M to be matched with the linear velocity of the photosensitive element 1K for K based on the FG signal. The second motor driver 202 determines a control target based on the FG signal and based on the algorithm or the data table.

This configuration allows determination of the linear velocity of the photosensitive element 1K and cost reduction without providing the roller encoder in the driven roller 14.

Figure 13:
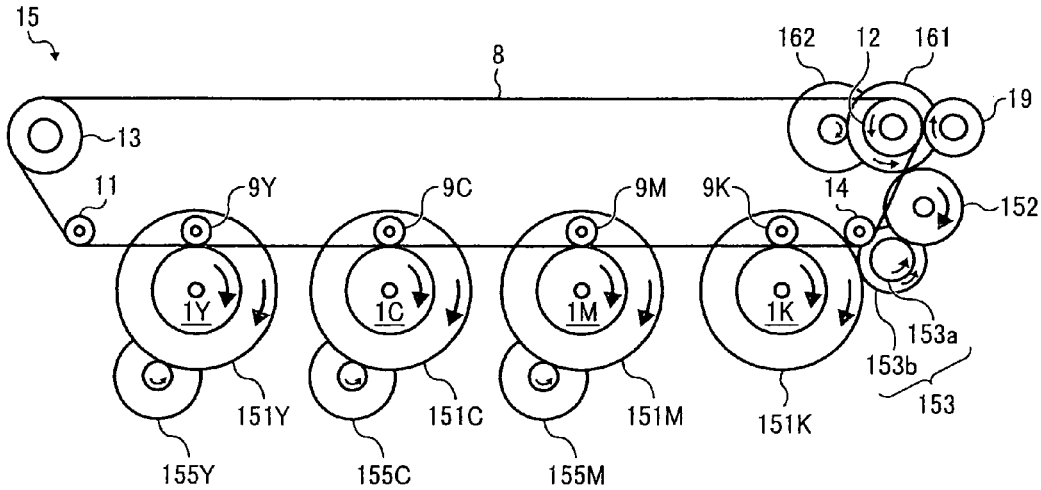
FIG. 13 is a schematic diagram representing a transfer unit, the photosensitive elements for the colors, and gears supported in the printer body in a second modification of the printer according to the first embodiment.

FIG. 13 is a schematic diagram representing a transfer unit, photosensitive elements for the colors, and gears supported in the printer body in a second modification of the printer according to the first embodiment. In the printer according to the second modification, the three photosensitive elements 1Y, 1C, and 1M for Y, C, and M are driven not by one color photosensitive-element motor but are driven by discrete photosensitive-element motors 155Y, 155C, and 155M, respectively. The photosensitive-element motors 155Y, 155C, and 155M engage their own motor gears with the photosensitive-element gears 151Y, 151C, and 151M respectively. The drive controller calculates the same values as each other as control targets of the photosensitive-element motors 155Y, 155C, and 155M for Y, C, and M based on the output, from the drum encoder (172), which reflects the angular velocity of the photosensitive element 1K for K. The drive controller corrects the control targets of the photosensitive-element motors 155Y, 155C, and 155M if necessary (if a difference between the calculated value and the current set value exceeds the threshold). In this manner, the present invention can be applied to even the configuration in which the photosensitive elements 1Y, 10, and 1M for Y, C, and M are driven by the discrete photosensitive-element motors 155Y, 155C, and 155M respectively.

Next, printers according to implementation examples in which more characteristic configurations are added to the printer according to the first embodiment are explained below. The configurations of the printers according to the implementation examples are the same as that of the first embodiment unless otherwise specified.

Figure 14:
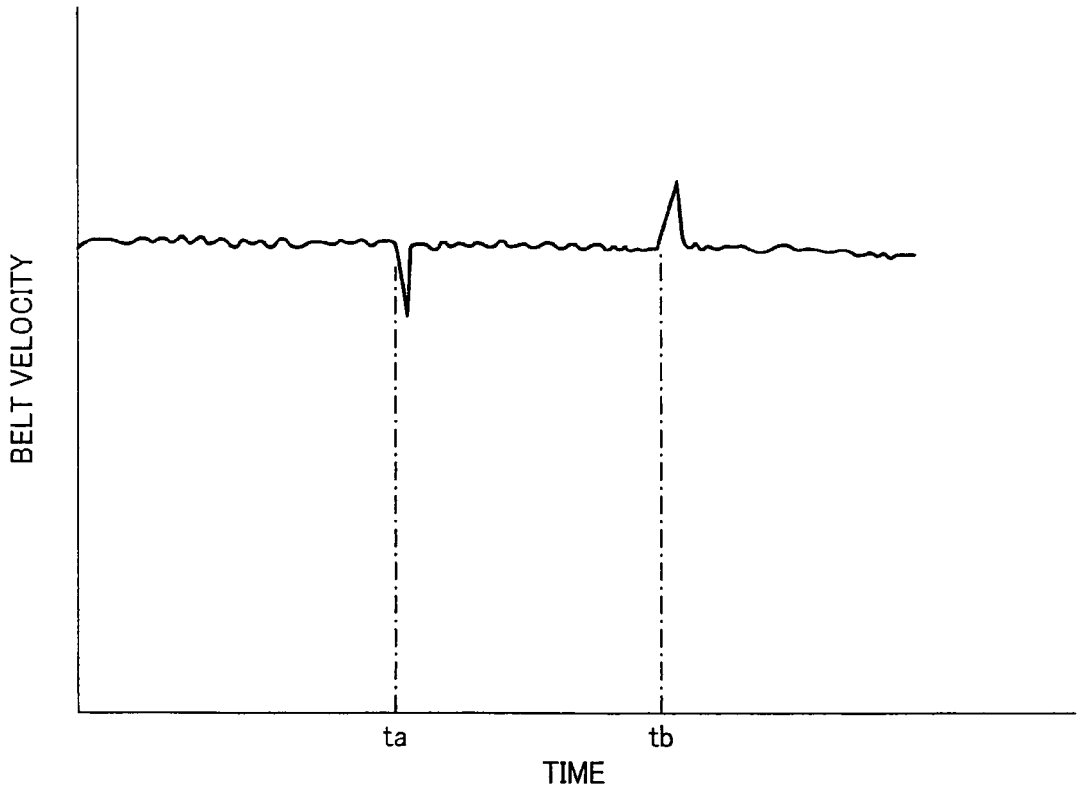
FIG. 14 is a graph representing a relationship between velocity of an intermediate transfer belt and time.

FIG. 14 is a graph representing a relationship between velocity of an intermediate transfer belt and time. In this graph, to indicates a time point when the leading edge of a recording paper enters the secondary transfer nip (hereinafter, called "at the time of entry of the paper leading edge"). Furthermore, tb indicates a time point when the trailing edge of the recording paper having entered the secondary transfer nip exits from the secondary transfer nip (hereinafter, called "at the time of ejection of the paper trailing edge"). As shown in this figure, at the time of entry of the paper leading edge (time point ta), the velocity of the intermediate transfer belt 8 significantly decreases for a short duration. Moreover, at the time of ejection of the paper trailing edge (time point tb), the velocity of the intermediate transfer belt 8 significantly increases for a short duration. Under the PLL control, by adjusting the drive speed of the shared drive motor 162 in quick response to such an instant velocity fluctuation, the duration for which the velocity fluctuation occur can be further reduced. However, the change amount of the drive speed at this time is comparatively large, and therefore, if the control target of the drive speed of the color photosensitive-element motor 154 is corrected with excellent responsivity by following the change amount, this causes a large linear velocity difference to occur between the photosensitive element 1K for K and the photosensitive elements 1Y, 1C, and 1M for Y, C, and M although only for an instant.

Therefore, the drive controller of the printer according to the first implementation example is configured to use an average value, within a predetermined time such as one cycle of the photosensitive element or one cycle of the belt, as an output value of the drum encoder 172 to be referred to for correcting the control target of the drive speed of the color photosensitive-element motor 154. This configuration allows reduction of the linear velocity difference of the photosensitive elements produced caused by the velocity fluctuation of the belt at the time of entry of the paper leading edge and at the time of ejection of the paper trailing edge, as compared with a case in which the control target of the color photosensitive-element motor 154 is corrected based on only the output values of the drum encoder 172 acquired at the time of entry of the paper leading edge and at the time of ejection of the paper trailing edge.

It should be noted that in the printer according to the first modification, FG signals are simply averaged instead of the output value of the drum encoder 172.

Figure 15:
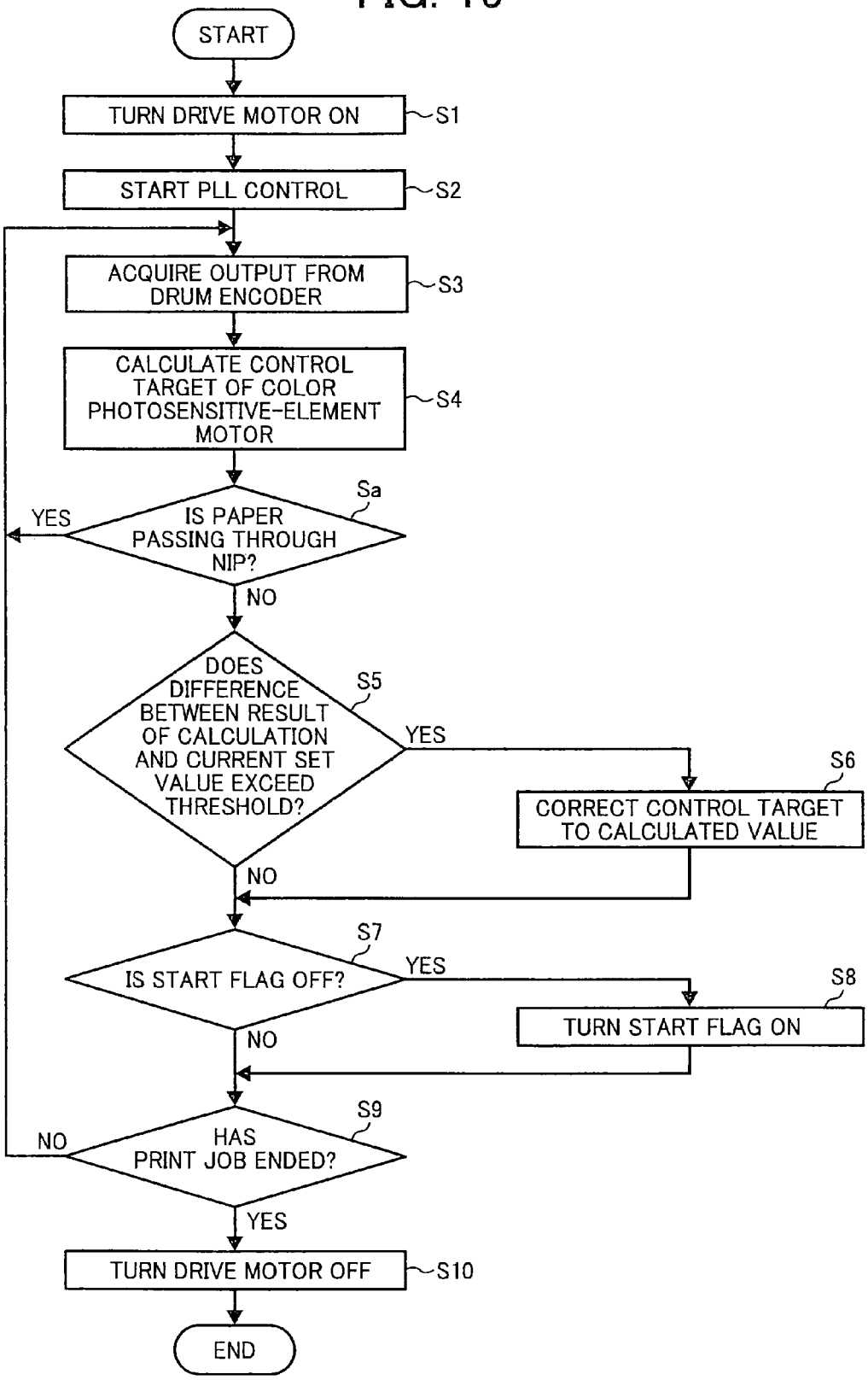
FIG. 15 is a flowchart representing a control flow executed by a drive controller in a printer according to a second implementation example.

FIG. 15 is a flowchart representing a control flow executed by a drive controller of the printer according to a second implementation example. The difference between this flow and the flow previously shown in FIG. 11 is that Step Sa is executed between Steps S4 and S5. At Step Sa, it is determined whether the paper is passing through the secondary transfer nip, and if it is not passing therethrough (No at Step Sa), the process proceeds to Step S5. If it is passing therethrough (Yes at Step Sa), the flow is looped to Step S3. More specifically, the drive controller of the printer according to the second implementation example is configured to execute a process for not reflecting the output value from the drum encoder 172, when the recording paper is caused to enter the secondary transfer nip, to the drive control of the color photosensitive-element motor 154.

This configuration allows avoidance of the linear velocity difference between the photosensitive elements produced caused by the velocity fluctuations of the belt at the time of entry of the paper leading edge and at the time of ejection of the paper trailing edge, unlike the case in which the control target of the color photosensitive-element motor 154 is corrected based on only the output values of the drum encoder 172 acquired at the time of entry of the paper leading edge and at the time of ejection of the paper trailing edge.

In the configuration in which the shared drive motor 162 is PLL-controlled based on the velocity of the intermediate transfer belt 8, if the diameter of the drive roller 12 deviates greatly from its standard value, then the control target of the shared drive motor 162 also deviates greatly from its standard value. Then, while the intermediate transfer belt 8 is driven at a target linear velocity, the photosensitive element 1K for K is driven at a linear velocity largely different from a standard linear velocity, and the linear velocity difference between the belt and the photosensitive element 1K is thereby comparatively increased. If the linear velocity difference is too large, then the transfer capability of the toner image from the photosensitive element 1K for K to the intermediate transfer belt 8 is significantly deteriorated, so that a target image density cannot be obtained.

Therefore, in the printer according to the third implementation example, the drive controller is configured so as to execute a process for performing PLL-control on the drive speed of the shared drive motor 162 within a range of a predetermined upper limit threshold or less. In this configuration, if the diameter of the drive roller 12 changes largely from the reference value to such an extent that the drive speed of the shared drive motor 162 is increased more than the upper limit threshold, by keeping the drive speed within the upper limit threshold, slight misregistration is allowed. However, the target image density can be obtained regardless of the change in the diameter of the drive roller 12. It should be noted that the control target of the color photosensitive-element motor 154 is determined based on the drive speed of the shared drive motor 162, and thus, similarly to the shared drive motor 162, the drive speed is controlled within the range of the predetermined upper limit threshold or less.

A printer according to a fourth implementation example is configured so as to control the drive speed of only the color photosensitive-element motor 154, of the shared drive motor 162 and the color photosensitive-element motor 154, within the upper limit threshold.

Figure 16:
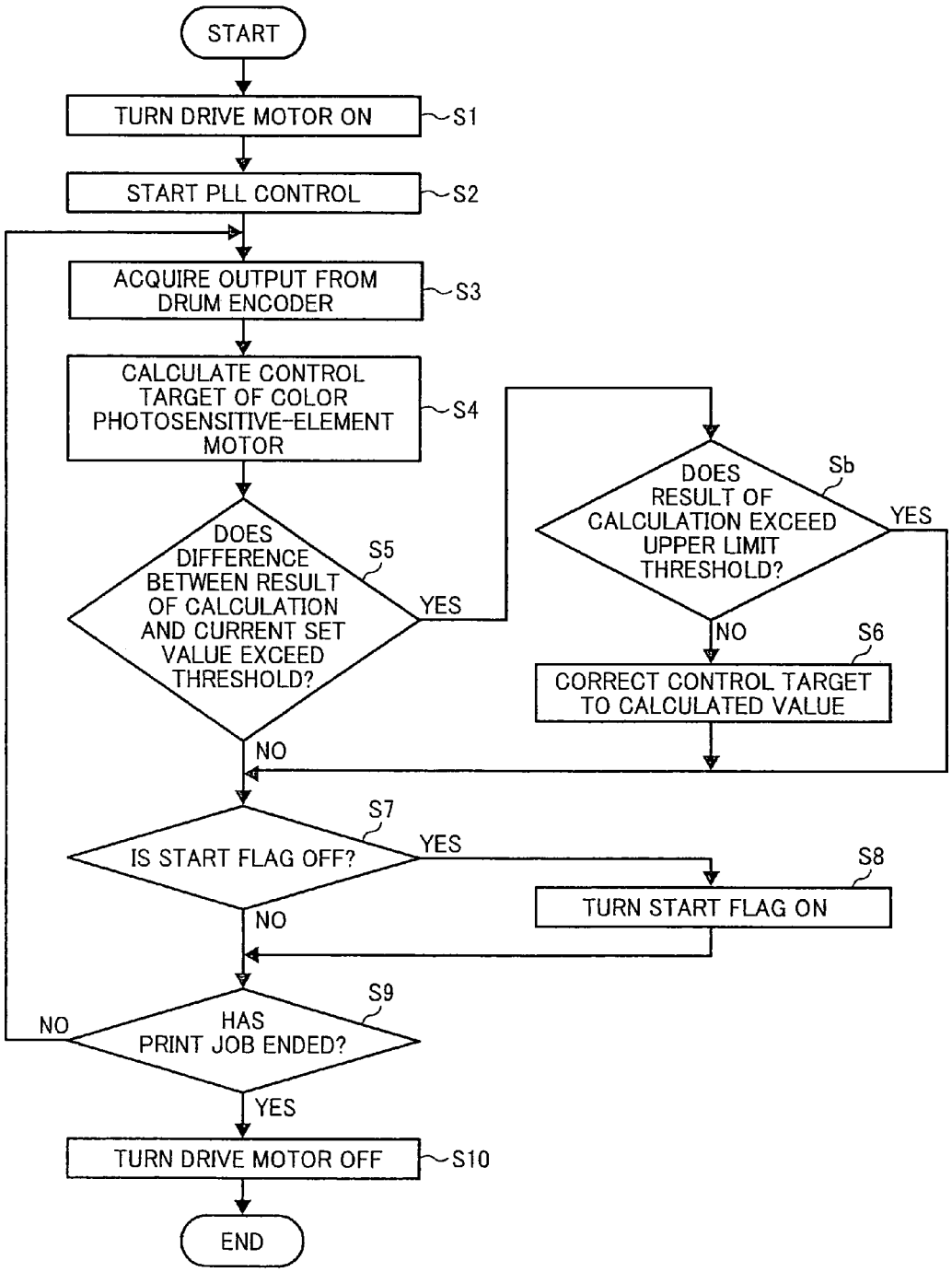
FIG. 16 is a flowchart representing a control flow executed by a drive controller in a printer according to a fourth implementation example.

FIG. 16 is a flowchart representing a control flow executed by a drive controller of the printer according to the fourth implementation example. The difference between this flow and the one shown in the flow previously shown in FIG. 11 is that Step Sb is executed between Steps S5 and S6. At Step Sb, it is determined whether the result of calculating a control target of the color photosensitive-element motor 154 exceeds the upper limit threshold, and only when the result does not exceed the upper limit threshold, the process proceeds to Step S6, where the control target is corrected to the calculated value.

This configuration enables target image densities for Y, C, and M to be obtained regardless of the change in the diameter of the drive roller 12. Instead of determining whether the result of calculating the control target of the color photosensitive-element motor 154 exceeds the upper limit threshold, the determination may be indirectly performed depending on whether the current drive speed of the shared drive motor 162 exceeds the upper limit threshold.

Next, a printer according to a second embodiment to which the present invention is applied is explained below. The configuration of the printer according to the second embodiment is the same as that of the first embodiment unless otherwise specified.

A drive controller of the printer according to the second embodiment is configured to perform constant-speed drive at a predetermined first drive speed instead of PLL-controlling the shared drive motor 162. The color photosensitive-element motor 154 is configured to perform constant-speed drive at a second drive speed according to the first drive speed of the shared drive motor 162 so as to match the linear velocity of the photosensitive elements 1Y, 1C, and 1M for Y, C, and M with the linear velocity of the photosensitive element 1K for K. The first drive speed and the second drive speed are periodically undated in four different timings as follows. Hereinafter, arrival of any one of these timings is called "arrival of periodic timing".

(1) Each time when power is applied to the body.

(2) Each time when a continuous stop time reaches a predetermined time or more.

(3) Each time when a printing operation (image forming operation) is performed predetermined times (each time when the printing operation is performed for a predetermined number of sheets).

(4) Each time when the printing operation in a continuous operation mode reaches predetermined times (each time when a number of continuously printed sheets reaches a predetermined number).

Figure 17:
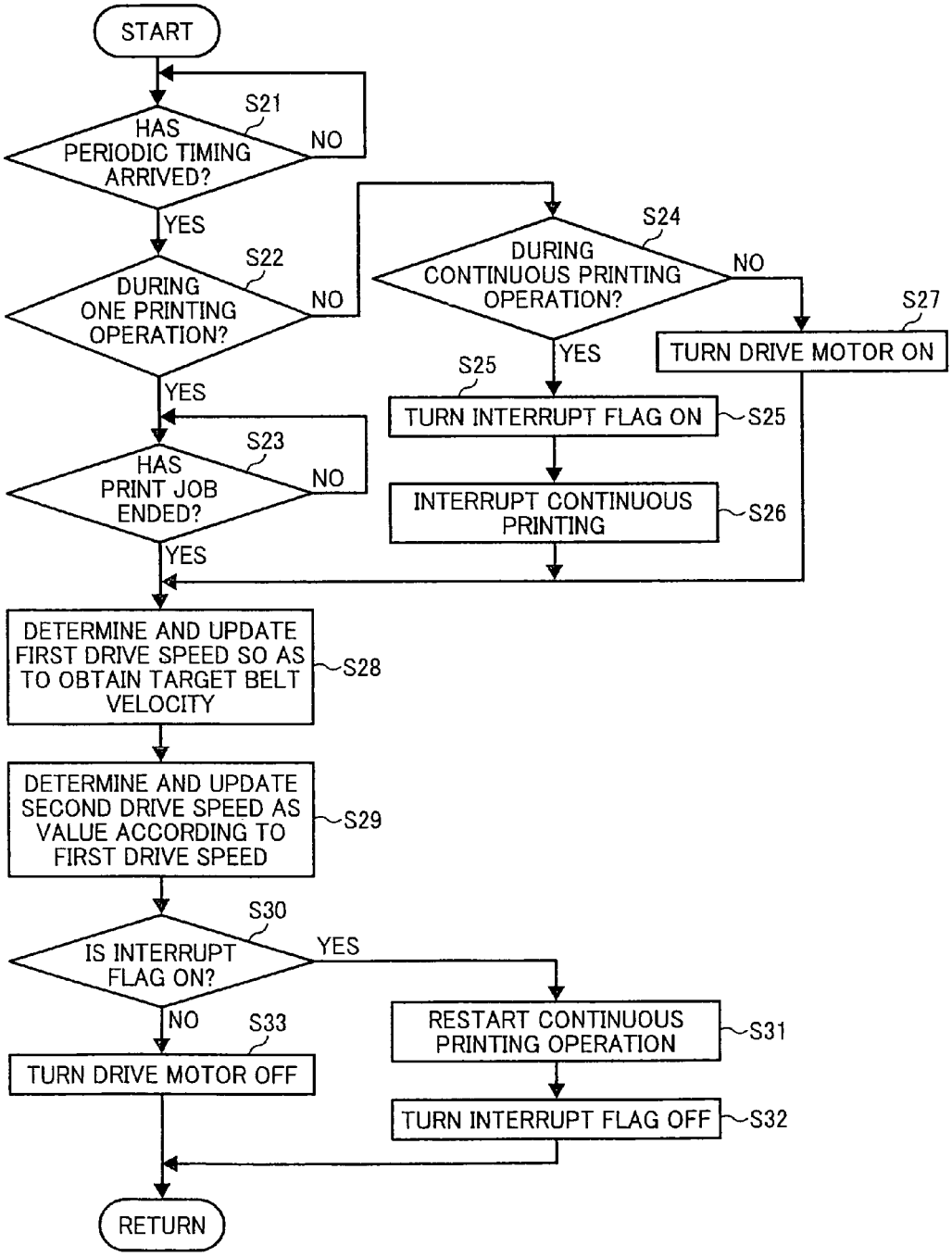
FIG. 17 is a flowchart representing a control flow executed by a drive controller in a printer according to a second embodiment.

FIG. 17 is a flowchart representing a control flow executed by the drive controller according to the second embodiment. In this figure, when the periodic timing has arrived (Yes at Step S21), then, it is determined whether the arrival is during one printing operation for printing only a sheet of recording paper, or during continuous printing operation, or during a standby state (Steps S22 and S24). If it is during the one printing operation (Yes at Step S22), the end of the print job is waited (Yes at Step S23), and then the process for updating the first drive speed is performed (Step S28). If it is during the continuous printing operation (Yes at Step S24), an interrupt flag is turned ON (Step S25), the continuous printing operation is interrupted (Step S26), and then the process for updating the first drive speed is performed (Step S28). On the other hand, if it is during the standby state (No at Step S24), the drive motor is turned ON (Step S27), and then the process for updating the first drive speed is performed (Step S28).

In the process for updating the first drive speed i.e., the drive speed of the shared drive motor 162 (Step S28), the drive speed of the shared drive motor 162 is adjusted so as to match detected velocity of the intermediate transfer belt 8 with the target linear velocity, and the result of adjustment is determined as a new first drive speed. The process is performed in the above manner, then, the second drive speed i.e., the drive speed of the color photosensitive-element motor 154 is determined based on the first drive speed and a predetermined data table (Step S29). The data table associates the first drive speed with the corresponding second drive speed (drive speed at which the linear velocity of the Y, C, and M photosensitive elements can be matched with that of the K photosensitive element). After the second drive speed is updated in this manner, the continuous printing operation is restarted, the interrupt flag is turned OFF, and the drive motor is tuned OFF (Steps S30 to S13) as necessary, and then the control flow is returned.

In the present printer configured in the above manner, by determining the first drive speed being the drive speed of the shared drive motor 162 in the subsequent printing operation in the periodic timing, based on the result of detecting the linear velocity of the intermediate transfer belt 8 driven by the shared drive motor, the belt can be endlessly moved at the target velocity regardless of the change in the diameter of the drive roller 12. In addition, in the periodic timing, by determining the second drive speed being the drive speed of the color photosensitive-element motor 154 according to the first drive speed, a linear velocity difference between the photosensitive element 1K for K and the photosensitive elements 1Y, 1C, and 1M for Y, C, and M is reduced. Thus, it is also possible to suppress occurrence of misregistration between visible images caused by the linear velocity difference.

It should be noted that the drive controller uses an average value within a predetermined time, as an output value from the roller encoder 171 being the result of detection by the velocity detector, when the first drive speed and the second drive speed are to be updated. At this time, the output value from the encoder when the recording paper is caused to enter the secondary transfer nip is not reflected to calculation of the average value. Furthermore, both the first drive speed and the second drive speed are determined within the predetermined upper limit threshold.

As explained above, the (1) to (4) different timings are adopted as the periodic timing, however, the printing operations in (3) and (4) are implemented by counting the number of operation times in the following manner. More specifically, based on A4-size paper as normal, when the printing operation is performed on the A4-size paper, the number of operation times is counted as one. On the other hand, when the printing operation is performed on a recording paper whose size in the conveying direction inside the device is one integer-th of the A4-size paper, the number of operation times is counted as one integer-th. Moreover, when the size is an integral multiple thereof, the number of printing operation times is counted as integral-multiple times.

Thus, in the printer according to the first implementation example, the transfer unit 15 being the transfer unit is configured to transfer the toner images carried on the surfaces of the photosensitive elements 1Y, 1C, 1M, and 1K to the surface of the intermediate transfer belt 8, and then transfer the toner images on the surface of the intermediate transfer belt 8 to the recording paper passing through between the intermediate transfer belt 8 and the secondary-transfer bias roller 19 being an opposed member provided opposite thereto. The drive controller 200 being the drive control unit uses the average value within the predetermined time as the output value, from the roller encoder 171, which is referred to for drive control of the color photosensitive-element motor 154 which is not the shared drive source. As already explained above, this configuration allows reduction of the linear velocity difference between the photosensitive elements produced due to the velocity fluctuations of the belt at the time of entry of the paper leading edge and at the time of ejection of the paper trailing edge, as compared with the case in which the control target of the color photosensitive-element motor 154 is corrected based on only the output values of the drum encoder 172 acquired at the time of entry of the paper leading edge and at the time of ejection of the paper trailing edge.

In the printer according to the second embodiment, the drive controller 200 is configured to use the average value within the predetermined time as the output value of the roller encoder 171 when the second drive speed is updated. This configuration allows reduction of the linear velocity difference between the photosensitive elements produced due to the velocity fluctuations of the belt at the time of entry of the paper leading edge and at the time of ejection of the paper trailing edge, as compared with the case in which the second drive speed is determined based on only the output values of the roller encoder 171 acquired at the time of entry of the paper leading edge and at the time of ejection of the paper trailing edge.

Furthermore, in the printer according to the second implementation example, the drive controller 200 is configured to execute the process for not reflecting the output value from the drum encoder 172, when the recording paper is caused to enter the secondary transfer nip, to the drive control of the color photosensitive-element motor 154. This configuration allows avoidance of the linear velocity difference between the photosensitive elements produced due to the velocity fluctuations of the belt at the time of entry of the paper leading edge and at the time of ejection of the paper trailing edge.

In the printer according to the second embodiment, the drive controller 200 is configured to execute the process for not reflecting the output value from the roller encoder 171, when the recording paper is caused to enter the secondary transfer nip, to these determined values of the drive speeds when the first drive speed and the second drive speed are determined respectively. This configuration allows avoidance of the linear velocity difference between the photosensitive elements produced due to the velocity fluctuations of the belt at the time of entry of the paper leading edge and at the time of ejection of the paper trailing edge.

In the printer according to the first embodiment and the printer according to the second embodiment, the drive controller is configured so as to execute the process for controlling the drive speed of at least either one of the shared drive motor 162 and the color photosensitive-element motor 154 within the predetermined upper limit threshold. This configuration allows achievement of target image density of the toner images which are transferred from the photosensitive elements driven, by controlling the drive speed within the upper limit threshold, at the controlled drive speed to the belt.

In the printer according to the second embodiment, for determining the first drive speed and the second drive speed, the printing operation for forming an image on A4-size paper is counted as one time, while the printing operation for forming an image on a recording paper whose size in the conveying direction is one integer-th or integral multiple of the A4 size is counted as one integer-th or integral multiple times. This configuration allows avoidance of improper updating time of the first drive speed and the second drive speed due to occurrence of an error between the result of counting and a practical amount of printing operation caused by the counting of the printing operation for one sheet of recording paper as one time irrespective of sizes of recording papers.

According to an aspect of the present invention, by changing the drive speed of the shared drive source according to the result of detecting the velocity fluctuation of the belt member, the belt member can be endlessly moved at the target velocity regardless of the change in the diameter of the drive rotating body. In addition, by controlling the drive speed of the image-carrier drive sources which are not the shared drive source based on the drive speed of the shared drive source or based on the velocity of the image carrier driven by the shared drive source, the linear velocity difference between the image carrier driven by the shared drive source and the image carriers respectively driven by the image-carrier drive sources which are not the shared drive source is reduced. Thus, occurrence of misregistration between the visible images caused by the linear velocity difference can also be suppressed.

According to another aspect of the present invention, by changing the drive speed of the shared drive source according to the result of detecting the velocity fluctuation of the belt member, the belt member can be endlessly moved at the target velocity regardless of the change in the diameter of the drive rotating body. In addition, by controlling the drive speed of the image-carrier drive sources which are not the shared drive source based on the angular velocity or based on the angular displacement of the image carrier driven by the shared drive source, the linear velocity difference between the image carrier driven by the shared drive source and the image carriers respectively driven by the image-carrier drive sources which are not the shared drive source is reduced. Thus, occurrence of misregistration between the visible images caused by the linear velocity difference can also be suppressed.

According to still another aspect of the present invention, by determining the drive speed of the shared drive source in the subsequent image forming operation based on the result of detecting the velocity of endless movement of the belt member driven by the shared drive source in periodic timing, the belt member can be endlessly moved at the target velocity regardless of the change in the diameter of the drive rotating body. In addition, in the periodic timing, by determining the drive speed of the image-carrier drive sources which are not the shared drive source according to the drive speed of the shared drive source, the linear velocity difference between the image carrier driven by the shared drive source and the image carriers respectively driven by the image-carrier drive sources which are not the shared drive source is reduced. Thus, occurrence of misregistration between the visible images caused by the linear velocity difference can also be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a rotatable image carrier corresponding to each of a plurality of colors and configured to carry a visible image of a corresponding one of the colors on a surface thereof;

a plurality of image-carrier drive sources configured to drive one or more of the image carriers;

a belt member that is stretched and supported by a plurality of stretching and supporting members in the vicinity of the image carriers;

a drive rotating body configured to support the belt member and when driven causes the belt member to endlessly move over the stretching and supporting members;

a belt drive source configured to drive the drive rotating body, wherein one of the image-carrier drive sources functions as the belt drive source as a shared drive source;

a velocity detector configured to detect velocity of the belt member when driven by the belt drive source;

a drive control unit configured to control a drive speed of the belt drive source based on a result of detection by the velocity detector;

a transfer unit configured to transfer the visible images from the surfaces of the image carriers onto a surface of the belt member or to a recording member held on the surface thereof; and a rotation detector configured to detect a parameter indicative of at least one among an angular velocity and an angular displacement of the shared drive source and an angular velocity and an angular displacement of the image carrier driven by the shared drive source, wherein the drive control unit executes a process for controlling a drive speed of the image-carrier drive sources other than the shared drive source based on the parameter detected by the rotation detector.

2. The image forming apparatus according to claim 1, wherein the transfer unit transfers the visible images from the surfaces of the image carriers onto the surface of the belt member, and then transfers the visible images from the surface of the belt member onto the recording member passing through between the belt member and an opposed member provided opposite to the surface of the belt member, and the drive control unit performs drive control of the image-carrier drive sources other than the shared drive source based on the drive speed of the shared drive source, the velocity of the image carrier driven by the shared drive source, or an average value within a set time detected by the rotation detector.

3. The image forming apparatus according to claim 1, wherein the transfer unit transfers the visible images from the surfaces of the image carriers onto the surface of the belt member, and then transfers the visible images from the surface of the belt member onto the recording member passing through between the belt member and an opposed member provided opposite to the surface of the belt member, and the drive control unit executes a process for not reflecting the drive speed of the shared drive source, the velocity of the image carrier driven by the shared drive source, or the parameter detected by the rotation detector, when the recording member enters between the belt member and the opposed member, in drive control of the image-carrier drive sources other than the shared drive source.

4. The image forming apparatus according to claim 1, wherein the drive control unit executes a process for controlling a drive speed of at least either one of the shared drive source and the image-carrier drive source other than the shared drive source to be lower than a set threshold.

5. An image forming apparatus comprising:

a movable image carrier corresponding to each of a plurality of colors and configured to carry a visible image of a corresponding one of the colors on a surface thereof;

a plurality of image-carrier drive sources configured to drive one or more of the image carriers;

a belt member that is stretched and supported by a plurality of stretching and supporting members in the vicinity of the image carriers;

a belt drive source configured to drive the belt member, wherein one of the image-carrier drive sources functions as the belt drive source as a shared drive source;

a velocity detector configured to detect a velocity of the belt member when driven by the belt drive source;

a drive control unit configured to control a drive speed of the belt drive source based on a result of detection by the velocity detector; and a transfer unit configured to transfer the visible images from the surfaces of the image carriers onto a surface of the belt member or to a recording member held on the surface thereof, wherein the velocity detector detects the velocity of the belt member when driven by the shared drive source at at least one detection timings selected from:

each time power of the image forming apparatus is turned on, each time a continuous stop time exceeds a set first value, each time number of times of execution of an image forming operation exceeds a set second value, and each time number of times of execution of an image forming operation in a continuous operation mode for continuously performing the image forming operation on a plurality of recording members exceeds a set third value, the drive control unit executes a process for determining a drive speed of the shared drive source and drive speeds of the image-carrier drive sources other than the shared drive source in subsequent image forming operations based on the velocity detection by the velocity detector, the transfer unit transfers the visible images from the surfaces of the image carriers onto the surface of the belt member, and then transfers the visible images from the surface of the belt member onto the recording member passing through between the belt member and an opposed member provided opposite to the surface of the belt member, and the drive control unit executes a process for not reflecting the velocity detected by the velocity detector, when the recording member enters between the belt member and the opposed member, in determination of the drive speed of the shared drive source and the drive speeds of the image-carrier drive sources other than the shared drive source.

6. The image forming apparatus according to claim 5, wherein the drive control unit determines the drive speed of the image-carrier drive sources other than the shared drive source based on an average value of the velocity within a set time detected by the velocity detector.

7. The image forming apparatus according to claim 5, wherein the drive control unit executes a process for controlling a drive speed of at least either one of the shared drive source and the image-carrier drive source other than the shared drive source to be lower than a set threshold.

8. The image forming apparatus according to claim 5, wherein the drive control unit executes a process for counting an image forming operation for forming an image on the recording member of a set size as one image forming operation for determining a drive speed of the shared drive source and a drive speed of the image-carrier drive sources other than the shared drive source, based on the velocity detected by the velocity detector at at least one detection timings selected from each time number of times of execution of an image forming operation exceeds a set fourth value, and each time number of times of execution of an image forming operation in a continuous image forming operation exceeds a set fifth value, and a process for counting an image forming operation for forming an image on a recording member whose size in a conveying direction in the apparatus is one integer-th or integral-multiple times of the set size, as one integer-th or integral-multiple times of the image forming operation.

* * * * *